US007115085B2

(12) United States Patent
Deal

(10) Patent No.: US 7,115,085 B2
(45) Date of Patent: Oct. 3, 2006

(54) METHOD AND APPARATUS FOR INCORPORATING OBJECTS INTO CIGARETTE FILTERS

(75) Inventor: Philip Andrew Deal, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 10/661,807

(22) Filed: Sep. 12, 2003

(65) Prior Publication Data

US 2005/0070409 A1 Mar. 31, 2005

(51) Int. Cl.
*B25F 5/02* (2006.01)
*A24B 15/30* (2006.01)

(52) U.S. Cl. ..... 493/49; 493/39; 493/47; 493/48; 493/941; 131/84.1; 131/275

(58) Field of Classification Search ..... 493/42, 493/47, 48, 49, 39, 40, 941, 4; 131/275, 131/84.1
See application file for complete search history.

(56) References Cited

U.S. PATENT DOCUMENTS 1,726,737 A 9/1929 Harris
2,808,057 A 10/1957 Jaksch
2,863,461 A 12/1958 Frost, Jr.
3,066,681 A 12/1962 Cohn
3,270,750 A 9/1966 Campbell
3,279,476 A 10/1966 Noznick et al.
3,288,145 A 11/1966 Rosenthal
3,297,038 A 1/1967 Homburger
3,334,636 A 8/1967 Zuber
3,339,557 A 9/1967 Karalus
3,339,558 A 9/1967 Waterbury
3,366,121 A 1/1968 Carty
3,390,686 A 7/1968 Irby, Jr. et al.
3,420,242 A 1/1969 Boukair
3,428,049 A 2/1969 Leake et al.
3,508,558 A 4/1970 Seyburn
3,513,859 A 5/1970 Carty
3,515,146 A 6/1970 Nealis
3,525,582 A 8/1970 Waterbury
3,547,130 A 12/1970 Harlow et al.
3,575,180 A 4/1971 Carty
3,596,665 A 8/1971 Lindgard
3,599,646 A 8/1971 Berger et al.
3,602,231 A 8/1971 Dock (Continued)

FOREIGN PATENT DOCUMENTS

DE 23 28 457 12/1973

(Continued)

*Primary Examiner*—John Sipos
*Assistant Examiner*—Christopher Harmon
(74) *Attorney, Agent, or Firm*—Brinks Hofer Gilson & Lione

(57) ABSTRACT

Cigarette filter rods having individual objects positioned at predetermined intervals therein are prepared by transferring the individual objects from a rotating horizontal pan to a rotating vertical wheel and then depositing the object into a web of filter tow. Each object is positioned within the moving web of tow. The web filter material and the objects positioned within the web are introduced into a rod-forming unit wherein the rod is formed. The rate of feed of the filter tow, the rate of rotation of the horizontal pan and the vertical wheel are controlled relative to one another such that objects are positioned at predetermined intervals along the rod. Cigarette filter elements having well controlled amounts of flavorant contained therein can be made from the rods.

13 Claims, 15 Drawing Sheets

U.S. PATENT DOCUMENTS

| | | | | |
|---|---|---|---|---|
| 3,602,235 | A | 8/1971 | Dock | |
| 3,625,228 | A | 12/1971 | Dock | |
| 3,635,226 | A | 1/1972 | Horsewell et al. | |
| 3,669,128 | A | 6/1972 | Cohen | |
| 3,683,936 | A | 8/1972 | O'Neil, Jr. | |
| 3,685,521 | A | 8/1972 | Dock | |
| 3,797,644 | A | 3/1974 | Shaw | |
| 3,834,285 | A * | 9/1974 | Schubert et al. | 493/45 |
| 3,916,914 | A | 11/1975 | Brooks et al. | |
| 3,972,335 | A | 8/1976 | Tiggelbeck et al. | |
| 3,991,773 | A | 11/1976 | Walker | |
| 4,003,387 | A | 1/1977 | Goldstein | |
| 4,046,063 | A | 9/1977 | Berger | |
| 4,046,153 | A | 9/1977 | Kaye | |
| 4,064,791 | A | 12/1977 | Berger | |
| 4,075,936 | A | 2/1978 | Berger | |
| 4,082,098 | A | 4/1978 | Owens, Jr. | |
| 4,126,141 | A | 11/1978 | Grossman | |
| 4,311,720 | A | 1/1982 | Marmo et al. | |
| 4,357,950 | A | 11/1982 | Berger | |
| 4,508,525 | A | 4/1985 | Berger | |
| 4,677,995 | A | 7/1987 | Kallianos et al. | |
| 4,729,391 | A | 3/1988 | Woods et al. | |
| 4,848,375 | A | 7/1989 | Patron et al. | |
| 4,862,905 | A * | 9/1989 | Green et al. | 131/84.1 |
| 4,865,056 | A | 9/1989 | Tamaoki et al. | |
| 4,881,555 | A | 11/1989 | Bolt et al. | |
| 4,889,144 | A | 12/1989 | Tateno et al. | |
| 4,920,990 | A | 5/1990 | Lawrence et al. | |
| 4,941,486 | A | 7/1990 | Dube et al. | |
| 5,012,829 | A | 5/1991 | Thesing et al. | |
| 5,025,814 | A | 6/1991 | Raker | |
| 5,067,500 | A | 11/1991 | Keritsis | |
| 5,074,320 | A | 12/1991 | Jones, Jr. et al. | |
| 5,105,838 | A | 4/1992 | White et al. | |
| 5,271,419 | A | 12/1993 | Arzonico et al. | |
| 5,331,981 | A | 7/1994 | Tamaoki et al. | |
| 5,360,023 | A | 11/1994 | Blakley et al. | |
| 5,396,909 | A | 3/1995 | Gentry et al. | |
| 5,474,092 | A | 12/1995 | Moser et al. | |
| 5,718,250 | A | 2/1998 | Banerjee et al. | |
| 5,724,997 | A | 3/1998 | Smith et al. | |
| 6,041,790 | A | 3/2000 | Smith et al. | |
| 6,336,896 | B1 * | 1/2002 | Hsu et al. | 493/39 |
| 6,417,156 | B1 | 7/2002 | Smith et al. | |
| 6,631,722 | B1 | 10/2003 | MacAdam et al. | |
| 2002/0020420 | A1 | 2/2002 | Xue et al. | |
| 2002/0119874 | A1 * | 8/2002 | Heitmann et al. | 493/39 |
| 2002/0166563 | A1 | 11/2002 | Jupe et al. | |
| 2003/0098033 | A1 | 5/2003 | Macadam et al. | |
| 2004/0261807 | A1 | 12/2004 | Dube et al. | |

FOREIGN PATENT DOCUMENTS

| | | |
|---|---|---|
| GB | 1132950 | 11/1968 |
| WO | WO 86/04488 | 8/1986 |
| WO | WO 02/03819 | 1/2002 |
| WO | WO 03/009711 | 2/2003 |
| WO | WO 03/039276 | 5/2003 |
| WO | WO 03/047836 | 6/2003 |

* cited by examiner

METHOD AND APPARATUS FOR INCORPORATING OBJECTS INTO CIGARETTE FILTERS

FIELD OF THE INVENTION

The present invention relates to smoking articles, and in particular, to smoking articles having the form of filtered cigarettes.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

The sensory attributes of cigarette smoke can be enhanced by applying additives to tobacco and/or by otherwise incorporating flavoring materials into various components of a cigarette. See, Leffingwell et al., *Tobacco Flavoring for Smoking Products*, R.J. Reynolds Tobacco Company (1972). For example, one type of tobacco flavoring additive is menthol. See, Borschke, *Red. Adv. Tob. Sci.,* 19, p. 47–70, 1993. Various proposed methods for modifying the sensory attributes of cigarettes have involved suggestion that filter elements may be used as vehicles for adding flavor to the mainstream smoke of those cigarettes. U.S. Pat. Appl. No. 2002/0166563 to Jupe et al. proposes the placement of adsorbent and flavor-releasing materials in a cigarette filter. U.S. Pat. Appl. No. 2002/0020420 to Xue et al. proposes the placement of fibers containing small particle size adsorbents/absorbents in the filter. U.S. Pat. No. 4,941,486 to Dube et al. and U.S. Pat. No. 4,862,905 to Green, Jr. et al. propose the placement of a flavor-containing pellet in a cigarette filter. Other representative types of cigarette filters incorporating flavoring agents are set forth in U.S. Pat. No. 3,972,335 to Tiggelbeck et al.; U.S. Pat. No. 4,082,098 to Owens, Jr.; U.S. Pat. No. 4,729,391 to Woods et al.; and U.S. Pat. No. 5,012,829 to Thesing et al.

Cigarettes having adjustable filter elements that allow smokers to select the level of flavor that is available for transfer into mainstream smoke have been proposed. See, for example, U.S. Pat. No. 4,677,995 to Kallianos et al. and U.S. Pat. No. 4,848,375 to Patron et al. Some proposed cigarettes may be manipulated, reportedly for the purpose of providing components of their filter elements with the propensity to modify the nature or character of mainstream smoke. See, for example, U.S. Pat. No. 3,297,038 to Homburger; U.S. Pat. No. 3,339,557 to Karalus; U.S. Pat. No. 3,420,242 to Boukar; U.S. Pat. No. 3,508,558 to Seyburn; U.S. Pat. No. 3,513,859 to Carty; U.S. Pat. No. 3,596,665 to Kindgard; U.S. Pat. No. 3,669,128 to Cohen; and U.S. Pat. No. 4,126,141 to Grossman. Some proposed cigarettes have capsules positioned in their filter elements, and the contents of those capsules reportedly are released into the filter elements upon rupture of those capsules in the attempt to alter the nature or character of the mainstream smoke passing through those filter elements. See, for example, U.S. Pat. No. 3,339,558 to Waterbury; U.S. Pat. No. 3,366,121 to Carty; U.S. Pat. No. 3,390,686 to Irby, Jr. et al.; U.S. Pat. No. 3,428,049 to Leake; U.S. Pat. No. 3,547,130 to Harlow et al; U.S. Pat. No. 3,575,1809 to Carty; U.S. Pat. No. 3,602,231 to Dock; U.S. Pat. No. 3,625,228 to Dock; U.S. Pat. No. 3,635,226 to Horsewell et al.; U.S. Pat. No. 3,685,521 to Dock; U.S. Pat. No. 3,916,914 to Brooks et al.; U.S. Pat. No. 3,991,773 to Walker; and U.S. Pat. No. 4,889,144 to Tateno et al. PCT WO 03/009711 to Kim proposes a filtered cigarette having at least one capsule containing aromatic material disposed in the filter section of that cigarette; and the application of pressure to the capsule reportedly causes the capsule to burst and discharge aromatic material into the filter so as to change the taste of the tobacco experienced during the course of smoking. Some proposed cigarettes have capsules positioned in their filter elements, and the contents of those capsules reportedly are released into the filter elements upon rupture of those capsules in order to deodorize the filter element after the cigarette is extinguished. See, for example, U.S. Pat. Appl. No. 2003/0098033 to MacAdam et al.

Commercially marketed "Rivage" brand cigarettes have included a filter possessing a cylindrical plastic container containing water or a liquid flavor solution. Cigarettes representative of the "Rivage" brand cigarettes are described in U.S. Pat. No. 4,865,056 to Tamaoki et al. and U.S. Pat. No. 5,331,981 to Tamaoki et al., both of which are assigned to Japan Tobacco, Inc. The cylindrical casing within the filter reportedly may be deformed upon the application of external force, and a thin wall portion of the casing is consequently broken so as to permit release of the liquid within the casing into an adjacent portion of that filter.

A cigarette holder has been available under the brand name "Aquafilter." Cigarette holders representative of the "Aquafilter" brand product are described in U.S. Pat. No. 3,797,644 to Shaw; U.S. Pat. No. 4,003,387 to Goldstein; and U.S. Pat. No. 4,046,153 to Kaye; assigned to Aquafilter Corporation. Those patents propose a disposable cigarette holder into which the mouth end of a cigarette is inserted. Smoke from the cigarette that is drawn through the holder reportedly passes through filter material impregnated with water. A disposable filter adapted to be attachable to the mouth end of a cigarette has been proposed in U.S. Pat. No. 5,724,997 to Smith et al. Flavor containing capsules contained within the disposable filter reportedly may be squeezed in order to release the flavor within those capsules.

Cigarettes incorporating distinctive flavors that provide a pleasurable sensory experience are clearly of interest to smokers. Some smokers may prefer a cigarette that is capable of selectively providing a variety of different flavors, depending upon the smoker's immediate desire. The flavor of such a cigarette might be selected based on the smoker's desire for a particular flavor at that time, or a desire to change flavors during the smoking experience. For example, changing flavors during the smoking experience may enable a smoker to end the cigarette with a breath freshening flavor, such as menthol or spearmint. Accordingly, it is desirable to provide a cigarette that is capable of providing different sensory experiences at the discretion of a smoker.

Some smokers may also desire a cigarette that is capable of selectively releasing a deodorizing agent upon completion of a smoking experience. Such agents may be used to ensure that the remaining portion of a smoked cigarette yields a pleasant aroma after the smoker has finished smoking that cigarette. Accordingly, it is desirable to provide a cigarette that is capable of releasing a deodorizing agent, particularly at the discretion of the smoker.

Some smokers may desire a cigarette that is capable of selectively moistening, cooling, or otherwise modifying the nature or character of the mainstream smoke generated by that cigarette. Because certain agents that can be used to interact with smoke are volatile and have the propensity to evaporate over time, the effects of those agents upon the behavior of those cigarettes may require introduction of those agents near commencement of the smoking experience. Accordingly, is desirable to provide a cigarette that is capable of selectively moistening, smoothing or cooling the smoke delivered to a smoker at the discretion of that smoker.

It would be highly desirable to provide smokers with the ability to enhance their smoking experience. That is, it would be desirable to provide a cigarette that can selectively provide a manner or method for altering, in a controlled way, the nature or character of the mainstream smoke produced by that cigarette. In particular, it would be desirable to provide a cigarette that is capable of releasing an agent for enhancing the sensory attributes of the mainstream smoke (e.g., by flavoring that smoke). It would be desirable to be able to produce such cigarettes at high rates of manufacture compatible with existing automated cigarette making equipment.

BRIEF SUMMARY OF THE INVENTION

The invention provides an apparatus and process for providing rods for use in the manufacture of smoking articles, each rod having objects individually spaced at predetermined intervals along the length thereof.

One embodiment of the apparatus includes a first rotatable member having a horizontal pan for supporting a plurality of individual objects and a plurality of stems located at predetermined intervals around the periphery of the pan. The stems have an object seat at an upper end of the stem and have vertical actuation to rise and lower the seat from a position below the pan to a position above the pan as the horizontal pan rotates about a central axis. The apparatus also includes means for positioning the individual objects within the supply of filler material at predetermined intervals. Preferably, one embodiment of the means includes a rotatable member having a plurality of pockets positioned at predetermined intervals along a peripheral face of the rotatable member.

One embodiment of the process includes continuously supplying individual objects by supporting a plurality of objects on a horizontal pan, rotating the pan to cause a plurality of stems received within holes in the pan to rise above the pan to lift an object seated on the stem, positioning the object within the supplied filler material and forming a continuous rod having the individual objects positioned at predetermined intervals within the rod. Preferably, one embodiment of the positioning comprises transferring the object from the stem to a first position on a vertical rotating member and rotating the object from the first position to a second position within the web of filter material.

These and other preferred embodiments of the invention are described in more detail below with reference to the appended drawings.

DETAILED DESCRIPTION OF THE INVENTION

The following description of a preferred embodiment of an apparatus and method for incorporating objects into a cigarette filter is described in the context of the insertion of a spherical capsule. Although a spherical capsule is a preferred object to be inserted, one of ordinary skill in the art may appreciate that other objects having the same or different shape may be inserted into cigarette filters in accordance with the teachings herein. Therefore, reference to capsule is to be understood to be illustrative and not limiting the invention. Like numerals in different figures refer to like parts.

Figure 1:
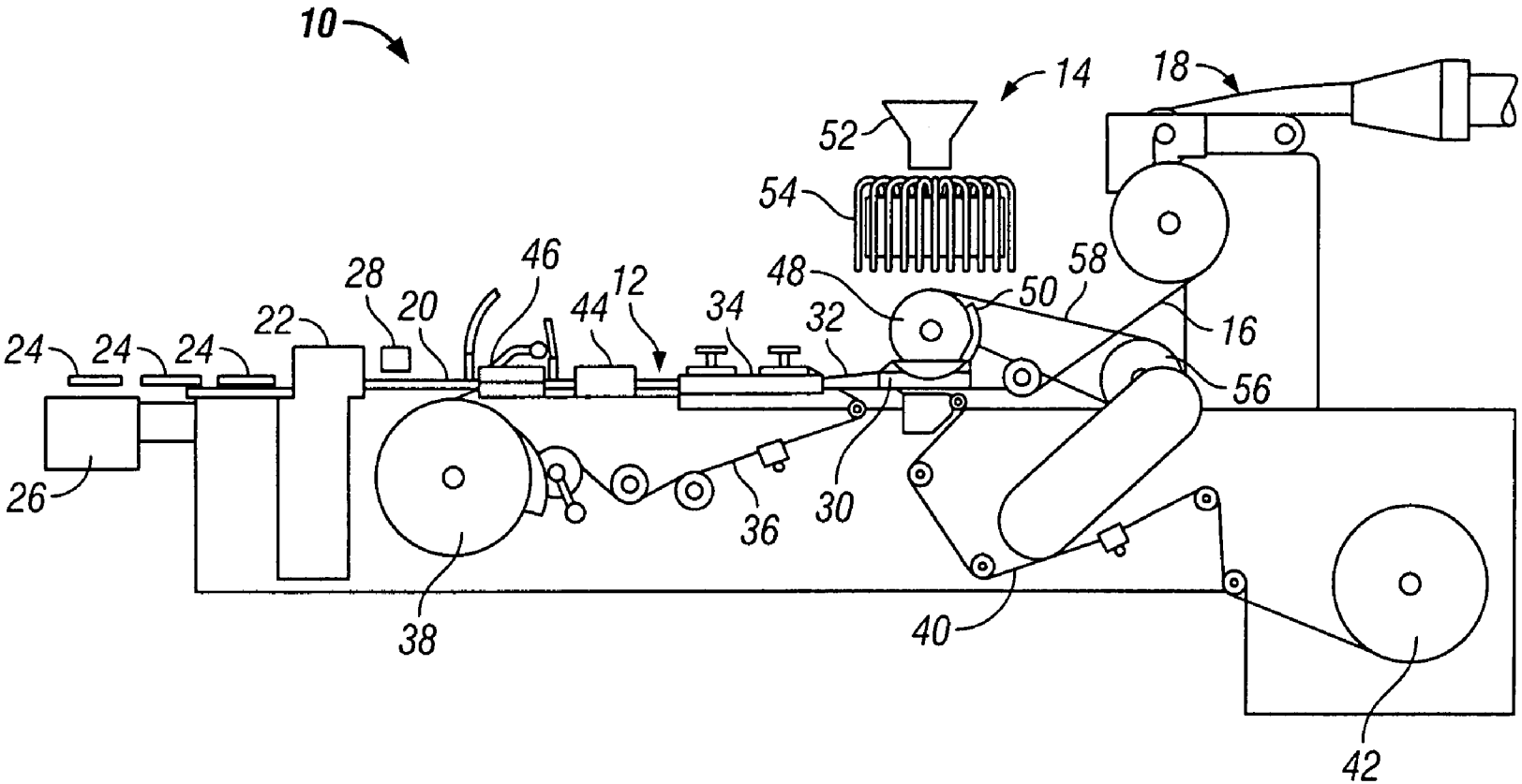
FIG. 1 is a diagrammatic illustration of one embodiment of the rod-making apparatus including a portion of the filter tow processing unit, the source of capsules, the capsule insertion unit, and the rod-forming unit.

Referring to FIG. 1, an exemplary rod-making apparatus 10 includes a rod-forming unit 12 and a capsule insertion unit 14 for placing objects at predetermined intervals within a continuous length of filter material 16. The continuous length of filter material is supplied from a source (not shown) such as a storage bale, bobbin, or the like. Generally, the filter material is processed using a filter material processing unit 18. The continuous length of filter material 16 which has objects incorporated therein at predetermined, spaced intervals is passed through the rod-forming unit 12 thereby forming a continuous rod 20, which can be subdivided by severing means 22 into a plurality of rods 24 which are collected using tray 26 or other suitable collection means. The severing means 22 may be synchronized with a capsule inspection means 28, such as a video inspection unit, to cut the continuous rod 20 at precise locations so that the objects or capsules are correctly positioned with the individual rods 24.

The production of filter rods, filter rod segments and filter elements, and the manufacture of cigarettes from those filter rods, filter rod segments and filter elements, in accordance with this invention, can be carried out using the types of rod-forming units 12 that have been employed to provide cigarette filters, multi-segment cigarette filters and filtered cigarettes. Multi-segment cigarette filter rods can be manufactured using a cigarette filter rod making device available under the brand name Mulfi from Hauni-Werke Korber & Co. KG of Hamburg, Germany. Other types of commercially available filter rod making equipment may similarly be used, such as the model KDF-2 available from Hauni-Werke Korber & Co. KG, or the model Decoufle available from Decoufle of France.

Six-up rods, four-up filter rods and two-up rods that are conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 Erdmann et al.; U.S. Pat. No. 4,281,670 to Heitmann et al.; U.S. Pat. No. 4,280,187 to Reuland et al.; and U.S. Pat. No. 6,229,115 to Vos et al.

Referring again to FIG. 1, filter material 16 is supplied and is passed into the rod forming unit 12. The filter material can vary and is any material that can be employed in providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary tow such as cellulose acetate, polyolefins such as polypropylene, or the like. For example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.

At least a portion of the filter material is generally absorbent of liquids, and hence capable of wicking the liquid payload components released from the capsule into the tow material for delivery to the smoker (or otherwise allowing for movement or transfer of the released capsule components throughout filter element). For example, filamentary tow such as cellulose acetate is processed using a conventional filter tow processing unit such as a commercially available E-60 supplied by Arjay Equipment Corp., Winston-Salem, N. C. Other types of commercially available tow processing equipment, as are known to those of ordinary skill in the art, may similarly be used. A portion of such an apparatus is designated by reference numeral 26 in FIG. 1. Normally a plasticizer such as triacetin is applied to the filamentary tow using known techniques. Other suitable materials for construction of the filter element will be readily apparent to those skilled in the art of cigarette filter design and manufacture.

Other types of cigarettes possessing multi-component filters also can incorporate those types of capsule-containing filter segments representative those made by the present invention. For example, capsule-containing filter segments of the present invention can be incorporated into the multi-component filter of cigarettes of the type set forth in U.S. Pat. No. 5,360,023 to Blakley; U.S. Pat. No. 5,396,909 to Gentry et al.; and U.S. Pat. No. 5,718,250 to Banerjee et al; U.S. Pat. Application No. 2002/0166563 to Jupe et al.; and PCT WO 03/047836 to Xue et al. Additional information regarding methods and apparatus for manufacturing other types of filter elements, which may be modified to contain capsules, are set forth in U.S. Pat. No. 4,046,063 to Berger; U.S. Pat. No. 4,064,791 to Berger; U.S. Pat. No. 4,075,936 to Berger; U.S. Pat. No. 4,357,950 to Berger; and U.S. Pat. No. 4,508,525 to Berger. The patents and patent applications listed above are hereby incorporated herein by reference.

Referring again to FIG. 1, the continuous length of filter material 16 is pulled through the block 30 by the action of the rod-forming unit 12 and the individual capsules are inserted at predetermined intervals within the web of filter material. The filter material is further directed into a gathering means 32 of the rod-forming unit 12. The gathering means can have a tongue and horn configuration, a gathering funnel configuration, stuffer or transport jet configuration, or the like. The tongue 32 provides for further gathering, compaction, conversion or formation of the cylindrical composite from block 30 into an essentially cylindrical (i.e., rod-like) shape whereby the continuously extending stands or filaments of the filter material extend essentially along the longitudinal axis of the cylinder so formed.

The filter material, which has been compressed into a cylindrical composite, is received into the rod-forming unit 12. The cylindrical composite is fed into wrapping mechanism 34, which includes endless garniture conveyer belt 36 or other garniture means. The garniture conveyer belt 36 is continuously and longitudinally advanced using advancing mechanism 38 such as a ribbon wheel or cooperating drum so as to transport the cylindrical composite through wrapping mechanism 34. The wrapping mechanism provides a strip of wrapping material 40 to the outer surface of the cylindrical composite in order to produce continuous wrapped rod 20.

The strip of wrapping material 40 is provided from rotatable bobbin 42. The wrapping material is drawn from the bobbin, is trained over a series of guide rollers, passes under block 30, and enters the wrapping mechanism 34 of the rod-forming unit. The endless garniture conveyer belt 36 transports both the strip of wrapping material and the cylindrical composite in a longitudinally extending manner through the wrapping mechanism 34 while draping or enveloping the wrapping material about the cylindrical composite. The wrapping material that circumscribes the filter material can vary. See, for example, U.S. Pat. No. 4,174,719 to Martin. Typically, the wrapping material is a porous or non-porous paper that is commercially available, and is known in the industry as "plug wrap." Exemplary highly porous plug wrap papers are available from Schweitzer-Maudit International as Porowrap Plug Wrap 17-M1, 33-M1, 45-M1, 65-M9, 95-M9, 150-M4, 260-M4 and 260-M4T.

The seam formed by an overlapping marginal portion of wrapping material has adhesive (e.g., hot melt adhesive) applied thereto at applicator region 44 in order that the wrapping material can form a tubular container for the filter material. Alternatively, the hot melt adhesive may be applied directly upstream of the wrapping material's entry into the garniture of the wrapping mechanism 34 or block 30, as the case may be. The adhesive can be cooled using chill bar 46 in order to cause rapid setting of the adhesive. It is understood that various other sealing means and other types of adhesives can be employed in providing the continuous wrapped rod.

The continuous wrapped rod 20 passes from the sealing means and is subdivided (e.g., severed) at regular intervals at the desired, predetermined length using cutting assembly 22 which includes as a rotary cutter, a highly sharpened knife, or the like. It is particularly desirable that the cutting means not flatten or otherwise adversely affect the shape of the rod. The rate at which the cutting assembly severs the continuous rod at the desired points is controlled relative to the rate at which the capsules are inserted into the continuous web of filter material. In one embodiment, the cutting assembly is geared in a direct drive relationship to the drive assembly of the rod-making apparatus. In another embodiment, the cutting assembly has a direct drive motor synchronized with the drive assembly of the rod-forming unit and feedback controlled by coupling with the capsule inspection means 28 to adjust the cutting assembly drive should the capsules insertion location shift out of position. A suitable manner for providing the required timing for severing the continuous rod at the desired length and with the desired number of capsules positioned at the predetermined intervals therein will be apparent to the skilled artisan.

The succession or plurality of rods 24 are collected for use in collection means 36 which is a tray, a rotary collection drum, or the like. If desired, the rods can be transported directly to a cigarette making machine. In such a manner, in excess of 1,400 rods, each of about 100 mm length, can be manufactured per minute.

The capsule insertion unit 14 includes a rotatable member 48 having the shape of a wheel, which may be optionally held in place within a ledger housing 50. The capsule insertion unit also includes a hopper 52 and/or other transfer means 54 for feeding or otherwise providing a passageway for the capsules to the rotatable member 48, which is also referred to in one embodiment as insertion wheel. In one embodiment, the rotatable member 48 is driven by a pulley 56 and belt 58 coupled with the main drive assembly of the rod-making apparatus 10. In another embodiment, the rotatable member 48 has an independent drive motor synchronized with or controlled by the main drive assembly.

Figure 2:
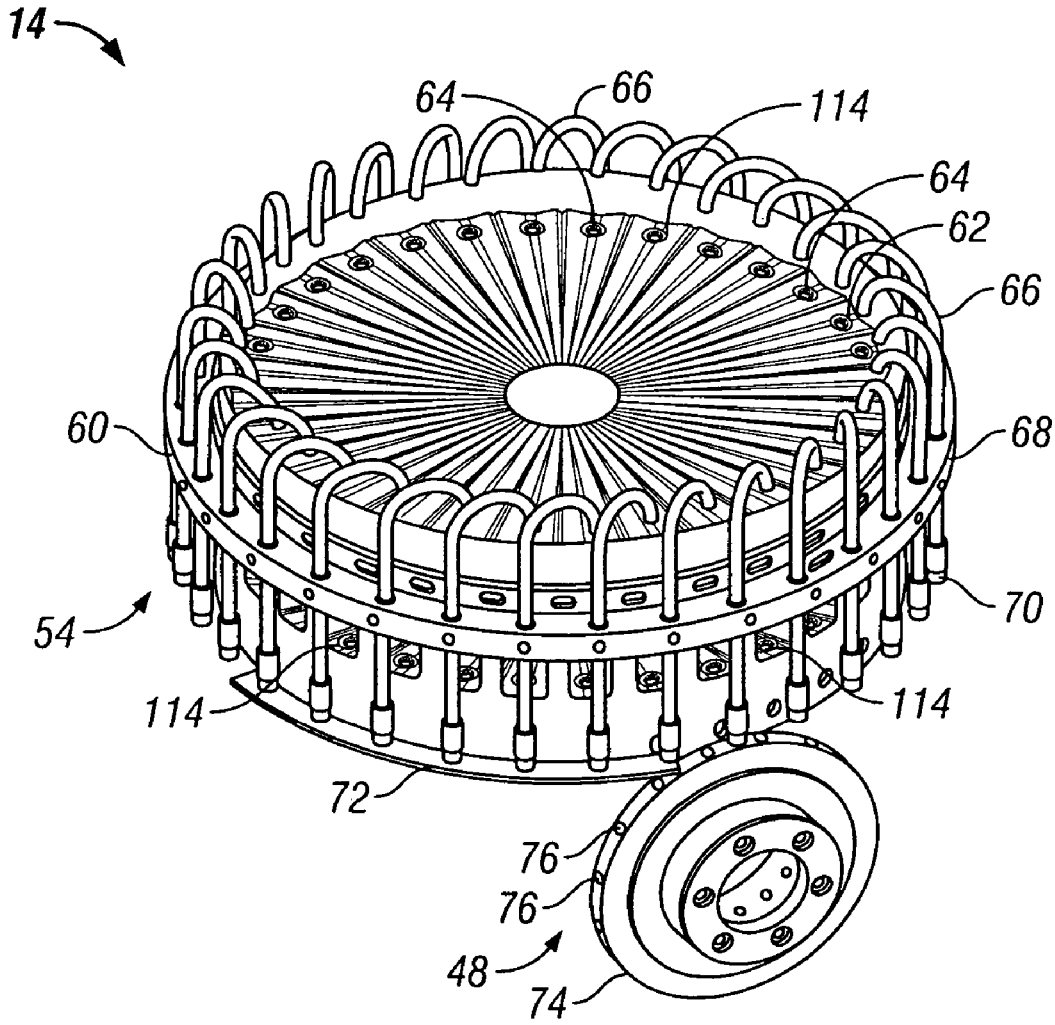
FIG. 2 is an enlarged perspective of a portion of the capsule insertion unit.

Referring to FIG. 2, one embodiment of the capsule insertion unit 14 is disclosed in greater detail. The transfer means 54 comprises a rotating carousel 60. The carousel has a horizontal pan 62 on the top with a series swales or troughs for directing the capsules to the perimeter of the pan where a plurality of holes 64 are evenly spaced around the perimeter of the plate. Inside the holes are stem lifters that lift a capsule up to a transfer tube 66 positioned directly over the hole 64. The transfer tubes are fastened to the carousel by a tube ring 68, which surrounds the carousel. As shown, the transfer tubes 66 guide the capsules from the pan to a position radially outward of the carousel circumference and below the carousel to be transferred to the rotatable member 48. At the bottom of the transfer tube 66 is a ball catcher 70, which is a narrow restriction in the transfer tube to centrally position the capsule at the bottom of the transfer tube. A fixed shelf 72 is provided under the ball catcher to retain the capsules in the transfer tubes until the capsules can be transferred to the rotatable member 48.

The rotatable member 48, in this embodiment, is an insertion wheel 74 that has a plurality of spaced pockets around the perimeter of the insertion wheel. The insertion wheel is positioned so that its peripheral face axially aligns a pocket with the bottom of a transfer tube during rotation of both parts.

In operation, the capsules are delivered from a feed hopper 52 to the pan 62 of a carousel 60. As the carousel rotates, centrifugal force moves the capsules to the perimeter of the pan 62 where the capsules gather over and around the holes 64. As the carousel rotates, each lifter, mounted flush with its hole, rises and captures a capsule, lifting the capsule to a predetermined apex beneath its respective transfer tube 66. The capture of the capsule may be assisted with vacuum supplied through the lifting stem. When the capsule reaches its apex and the transfer tube 66 is aligned over the shelf 72, a positive air pressure is applied to the stem lifter that then blows the capsule up into the transfer tube and down to the ball catcher 70. As the carousel further rotates, the capsule moves along the shelf 72 and at its terminus, drops into a pocket 75 of the insertion wheel 74. The insertion wheel 74 and the carousel 60 are driven in synchronization so that each transfer tube 66 aligns with a pocket 75 of the insertion wheel. The carousel and insertion wheel may be driven in synchronization geared to a single motor, or may have independent drives that are servo-controlled for synchronization. As will be explained below, as the insertion wheel 74 rotates, the capsules held within the pocket 75 are brought into contact with the filter material 16 within the block 30 where the capsule is then ejected from the pocket into the gathering filter material.

Because of the centrifugal force developed by the rotation of the carousel and with the assistance of the swales on the surface of the pan, the capsules are evenly distributed to the perimeter of the top plate. It is preferred that the carousel rotate at a speed sufficient to match the maximum production speed of the rod-forming unit. A typical rod-forming unit described in FIG. 1 can make up to 2000, "four up" cigarette filter rods per minute, (i.e. 8000 cigarette filters). For ease of synchronization with the internal drive of the rod-forming unit and to have a manageable size of equipment, it is desirable to have an insertion wheel with 16 pockets around its periphery and a carousel with 32 stem lifters. This provides easy 2 to 1 direct gear ratio so that a direct gearing of the two rotating devices may be easily achieved. It has been found that the rotating carousel as one embodiment of a transfer means is a way to transfer capsules with minimal strain or stress at high production rates. The carousel can singulate and separate single capsules from a pool and put them into a system properly spaced to deliver to a filter material. Larger diameter carousels and insertion wheels may be used to slow down the transfer and acceleration of the capsules to reduce the strain and stress. However, one of ordinary skill in the art will appreciate that size limitations may be based on the available space surrounding typical rod-making apparatus that are commercially available.

Figure 3:
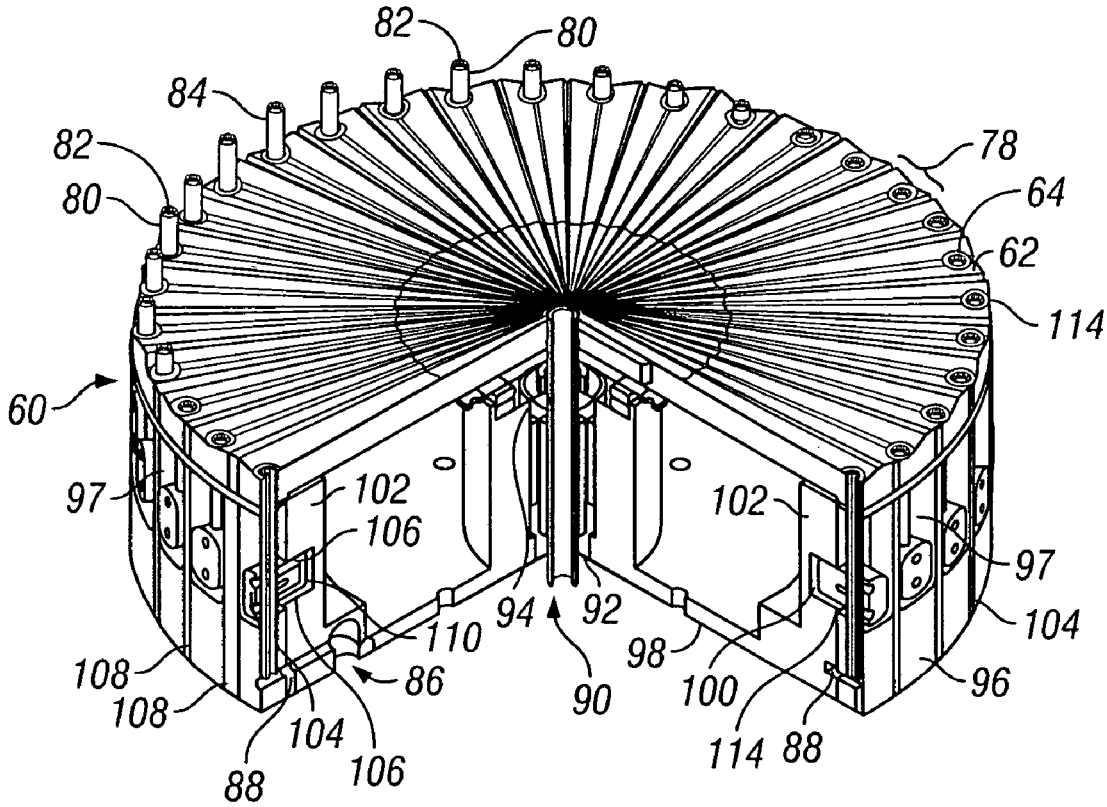
FIG. 3 is a perspective of the carousel of the capsule insertion unit of FIG. 2 with a portion of the carousel shown as partially cut away.

Referring to FIG. 3, an enlarged perspective of the carousel 60 is shown with a portion of the carousel cutaway. The carousel 60 has a horizontal pan 62 on the top. A series swales or troughs 78 extend radially from the center of the pan. These troughs 78 provide a shallow channel for the radial movement of the capsule to the perimeter of the pan 62. A hole 64 is centered at the end of each trough 78. Within each hole 64 is a capsule stem lifter 80. In one preferred embodiment, the capsule stem lifter is a hollow tube with relief slots 82 cut out at the top of the stem. The relief slots 82 allow for air to flow around and pass the capsule into the stems as a vacuum is applied to the stems. As the carousel rotates the stems rise and fall. At the maximum height of the extension of the stem shown as at stem 84, a positive air pressure is applied to the stem to blow out the capsule into transfer tube 66 as described with FIG. 2.

Referring again to FIG. 3, the cutaway revealing the interior of the carousel 60 shows a vacuum inlet port 86 leading into a vacuum channel 88 at the bottom of the carousel. The vacuum channel 88 preferably extends more than half way around the circumference of the carousel to provide the suction for the stem lifters in communication with the channel to "grab" onto a capsule so that it may be lifted up to the transfer tube. Near the apex or point of maximum stem lift, the vacuum channel stops, and the stem lifter moves to a position in communication with an air pressure supply port that is provided at the bottom of the carousel.

The stems 80 rise and fall with cam actuation. A drive shaft 90 contained within ball bearings 92 and thrust bearings 94 is connected to the top pan 62, which is then connected to the carousel skirt 96. The top pan and carousel skirt rotate around a fixed cam drum 98, which comprises the bottom of the carousel. The cam drum 98 has a cam channel 100 found in the side wall 102 of the cam drum. The cam channel 100 forms a continuous path around the perimeter of the cam drum and defines the rise and fall of the stem lifters 82. Attached to each stem lifter 80 is a cam block 104 and a cam follower 106. A cam block is fixed to the stem with two set screws 108 and a cam follower is secured to the cam block with a bolt 110. As the pan 62 rotates, the cam follower 106 rides within the cam channel 100 as the carousel rotates to cause the stem to rise and lower along with the rise and fall of the cam channel in the side walls of the cam drum 98. Brass bushings 114 are preferably located in the carousel holes 64 to position the lifting stems about the periphery of the pan 62 and skirt 96 and guide their vertical movement.

Figure 4:
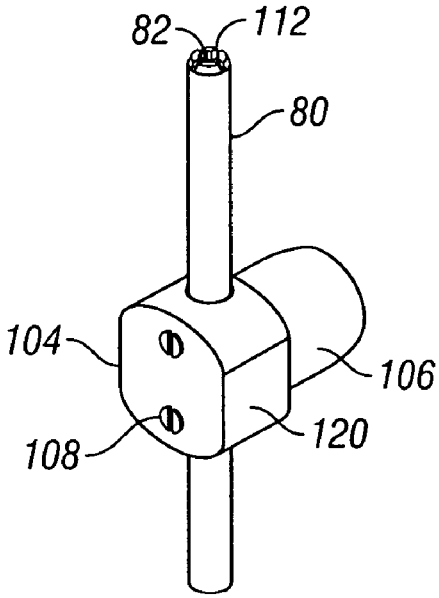
FIG. 4 is an enlarged perspective of the cam block and stem of the carousel of FIG. 3.

Referring now to FIG. 4, a detailed perspective of the embodiment of the stem lifter and cam of FIG. 3 is depicted. The stem lifter 80 has relief slots 82 at the top end of the stem lifter, which is chamfered or concaved to provide a seat surface 112 for the capsules that are retained on the top of the stem lifters through the vacuum applied at the bottom of the stem. The cam block 104 is positioned on the stem 80 and fixed in place with two set screws 108. The cam follower wheel 106 rises within the cam channel 100. Sides 120 of the cam block 104 cooperate with the guides 97 in the skirt 96 of the carousel 60 to prevent rotation of the cam block assembly about the axis of the stem lifter 80.

Figure 5:
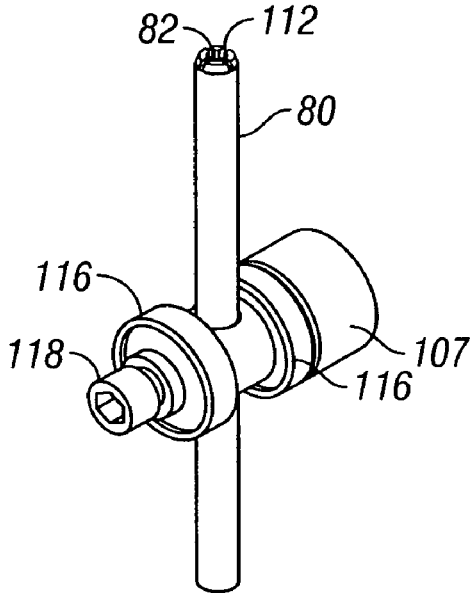
FIG. 5 is an enlarged perspective of an alternate embodiment of a cam block and stem.

Referring now to FIG. 5, another embodiment of a stem and cam block is shown. In this embodiment the stem 80 has similar relief slots 82 and capsule seat 112 as previously described. The cam block includes a set of wheels 116 to ride up and down in the cam block guides 97. The cam block 116 is fixed to the stem 80 with a machine screw 118. A cam follower wheel 107 is positioned adjacent the inner wheel 116.

Figure 6:
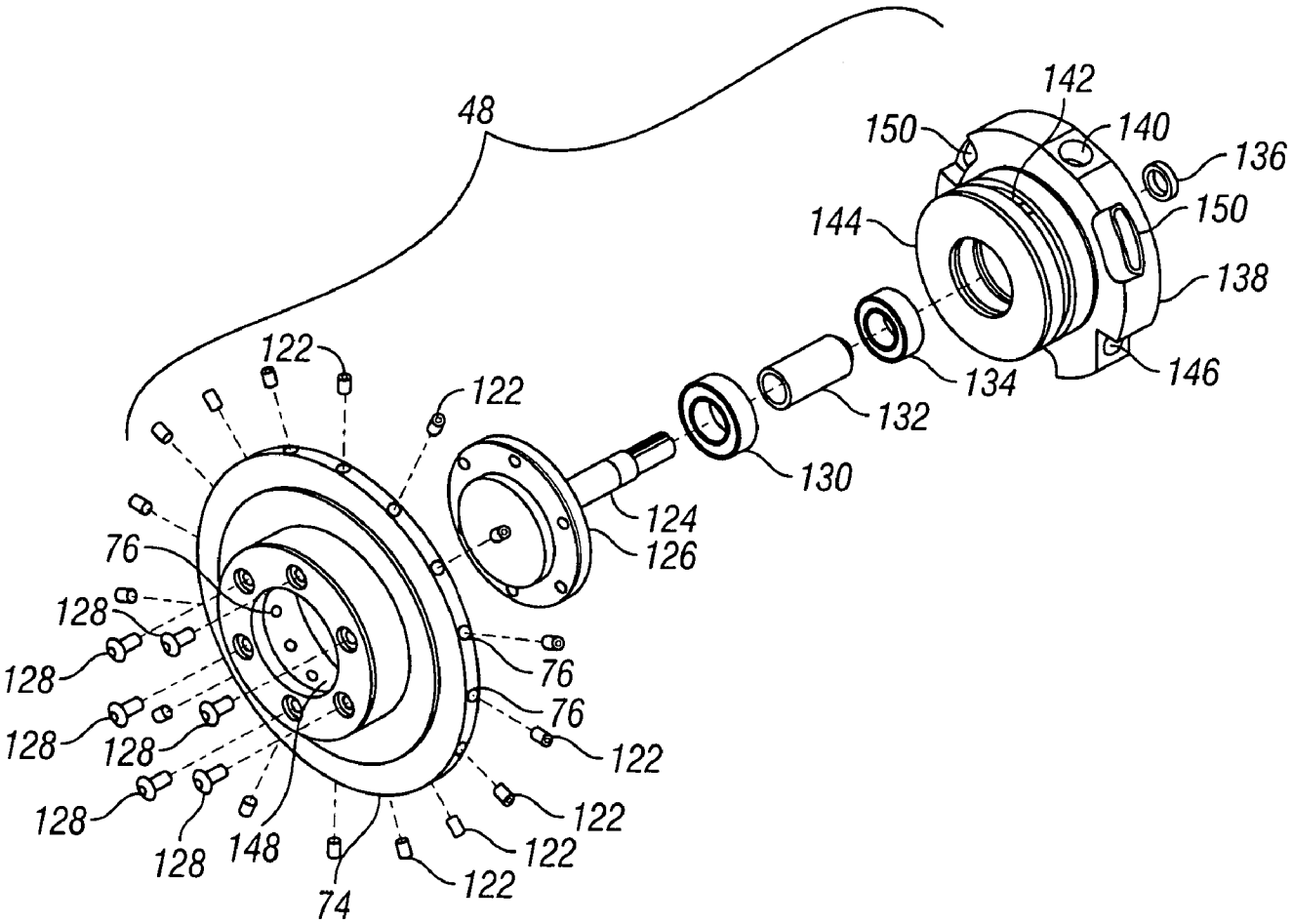
FIG. 6 is an exploded perspective of the capsule insertion wheel of FIG. 2.

Referring now to FIG. 6, the rotatable member 48 with the embodiment including the insertion wheel 74 is depicted in an exploded perspective view. As described above, the insertion wheel 74 includes a series of pockets 76 equally spaced around the peripheral face of the wheel. The pockets 76 are holes drilled through the wheel extending all the way through and in communication with the center opening of the wheel. Within each pocket 76, a capsule seat 122 is positioned near the radial end of the pocket. The capsule seat 122 is generally a hollow, ribbed structure that provides a seat or cradle to retain the capsule as the wheel rotates. More details of different embodiments of the capsule seats are described below.

The insertion wheel 74 is mounted onto a drive shaft 124 and bolted to a mounting flange 126. A set of bolts 128 through the outboard surface of the insertion wheel retain the wheel against the mounting flange. The drive shaft 124 is inserted through a set of ball bearings 130 and 134 separated by a bushing 132 and retained by traditional methods within the bearing housing 138. Spacer ring 136 cooperates with drive components not shown. The bearing housing includes a vacuum port 140 in communication with a vacuum channel 142 that is cut into the outside peripheral surface of the hub 144. A positive air supply port 146 is provided on the bearing housing and channeled through to the bearing housing hub 144 at a single point corresponding to the location where a pocket is positioned to insert into the filter material. The insertion wheel 144 fits down over the bearing housing hub 144 so that the inside surface 148 of the insertion wheel rotates around the hub with the insertion wheel pockets 76 riding over the vacuum channel 142. The drive shaft 124 is centered inside the bearing housing 138 so that it retains the insertion wheel 74 concentrically about the bearing housing hub to maintain a small air gap between the hub and the inside surface 148 so there is no contact between the parts. In this manner, a vacuum seal is provided between the bearing housing and the insertion wheel without the need for bearings, bushings or other contacting seals between the two parts. Bolt holes 150 are provided around the perimeter of the bearing housing to allow for adjustable mounting of the bearing housing to a support bracket (not shown) on the rod-making apparatus 10.

Figure 7:
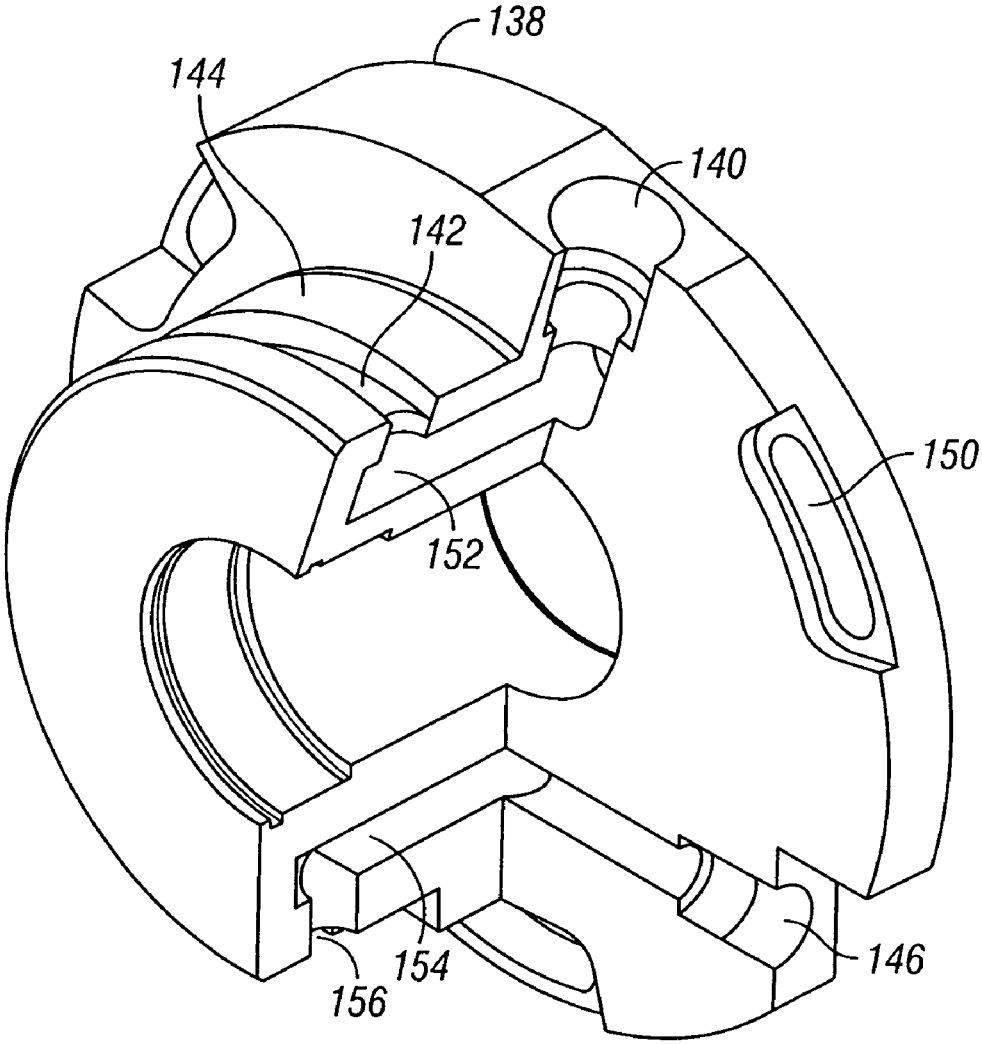
FIG. 7 is an enlarged cut-away perspective of the mounting housing for the insertion wheel of FIG. 6.

Referring now to FIG. 7, a detailed perspective view of the bearing housing 138 is shown with a partial cutaway. In the cutaway portion the vacuum port 140 is visibly shown in communication with a vacuum channel 142 via a passage 152 drilled out from the backside of the bearing housing. Also in this view, the positive air supply port 146 is shown visibly in communication with a drilled out air supply passage 152 in communication with the air ejection port 156. In operation, as the insertion wheel 74 rotates around the bearing housing 138 with the pockets 76 rotating over the vacuum channel 142, a vacuum is applied to the capsule seats 122 to retain a capsule thereon. When the pockets rotate over the air ejection port 156, the vacuum switches to a positive air supply which ejects the capsule into the filter material.

Figure 8:
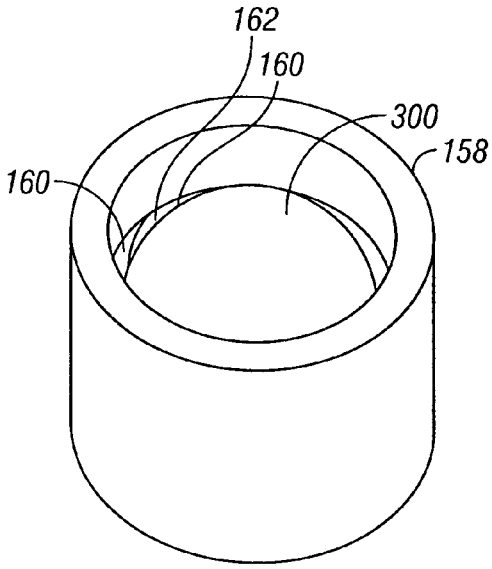
FIG. 8 is an enlarged perspective of a capsule seat with a capsule in place used with the capsule insertion wheel of FIG. 6.

Referring now to FIG. 8, one embodiment of a capsule seat 122 is shown. The capsule seat is a hollow tube 158 with internal protrusions 160, which support the capsule inside the capsule seat. An air gap 162 is provided between the capsule 300 and the interior inside surface of the capsule seat. The air gap allows air to flow around all sides of the capsule seat as a vacuum is applied below the capsule seat in the pocket of the insertion wheel. It has been found that without this air gap, the capsule can become aerodynamically captured in the capsule seat, and was difficult to remove from the capsule seat to insert into the filter material. Thus, it is preferable to use the capsule seats in the pockets around the insertion wheel. The preferred capsule seats include an air gap between the capsule and the inside walls of the capsule seats. This air gap allows air to flow around the capsule to minimize strain on a capsule. Preferably, the capsule sits on top of the ribs or protrusions so that the top of the capsule is generally flushed with the outside diameter of the insertion wheel. Also, it is preferred to have a sufficient size air gap so that the flutes between the ribs or protrusions of the capsule seats are directly exposed so that the capsules may be easily ejected from the pockets when the positive air supply replaces the vacuum. The capsule seats may be made out of rigid plastics or polymeric material such as polyethylene ethylene ketone (PEEK) or nylon. Alternatively, the capsule seat may be metal, ceramic or a composite structure. One of ordinary skill in the art may understand that there are numerous other materials that may be suitable for use with the capsule seats.

Figure 9:
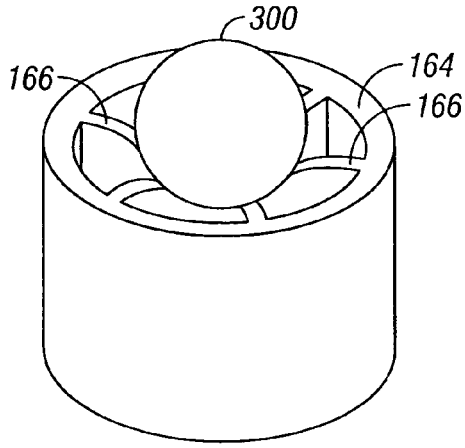
FIGS. 9, 10 and 11 are enlarged perspective of alternate embodiments of a capsule seat useful with the capsule insertion wheel of FIG. 6.
Figure 10:
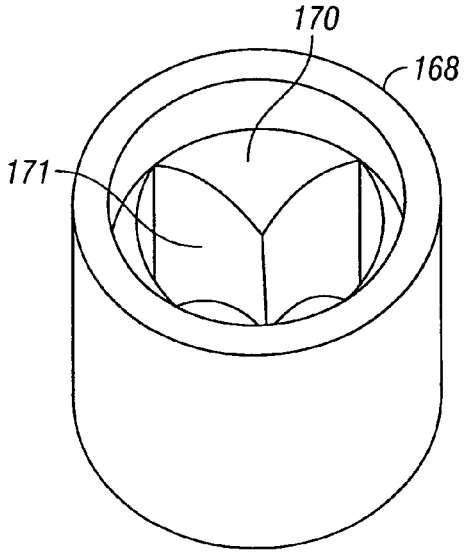
Figure 11:
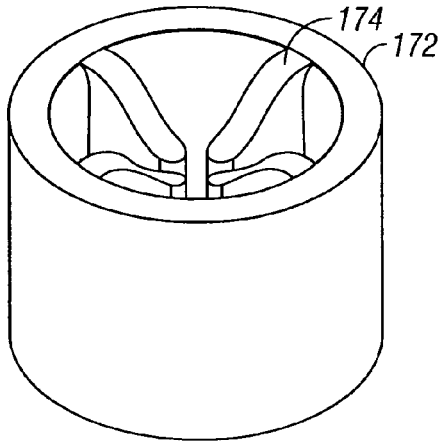

Referring to FIGS. 9, 10 and 11, three more alternative embodiments for capsule seats are shown. FIG. 9 discloses a capsule seat 164 with six radially aligned internal ribs 166 which support a capsule 300. FIG. 10 discloses a capsule seat 168 having four internal protrusions 170 or, alternatively, four flutes 171 formed by drilling out a solid tube. FIG. 11 discloses a capsule seat 172 having four internal ribs 174. In each case the internal diameter of the capsule seats is larger than the outside diameter of the capsules to provide an air gap all around the perimeter of the capsule for the reasons noted above.

Referring again to FIG. 6, the capsule insertion unit includes a rotatable wheel 74 having a series of pockets 76 positioned at predetermined intervals along the periphery thereof. The series of pockets 76 which are positioned along the peripheral face of the wheel are at equally spaced intervals. The number of pockets present in the peripheral face of the wheel generally is dependent upon the manner in which the strand is introduced to the pocket, the rate of rotation of the wheel relative to the rate of feed of filter material, and the desired spaced of the individual capsules within the filter rod. For example, a wheel of about 4.2 inch (107 mm) diameter can have 16 pockets, the centers of which are equally spaced at a 21 mm distance. As another example, a wheel of about 6.22 inch (158 mm) diameter can have 16 pockets, the centers of which are equally spaced at 31 mm distance. The diameter of the wheel 74 can vary. Typically, the diameter of the wheel is dictated by factors such as the shape, spacing and number of pockets in the peripheral face thereof, and the rate at which the wheel is required to rotate. For most applications involving the manufacture of filter rods for smoking articles, the diameter of the wheel preferably ranges from about 4 inches to about 8 inches. The wheel 74 is manufactured from pre-tempered, cold-rolled steel, or the like.

The width of wheel 74 is predetermined according to factors such as, but not limited to, the circumference of the continuous rod, which is manufactured according to this invention, and the diameter of the capsules. Generally, the width of the wheel is the width of the peripheral face of the wheel. Of particular interest is a wheel having a width of about 0.25 inch. A wheel with such a width can conveniently be used for the manufacturing of rods having a circumference of about 25 mm. The width of each pocket is less than the width of the peripheral face of the wheel, and typically is determined by the diameter of the capsule that enters the pocket (i.e., the width of the pocket is greater than the diameters of the capsule and the capsule seat).

Figure 12:
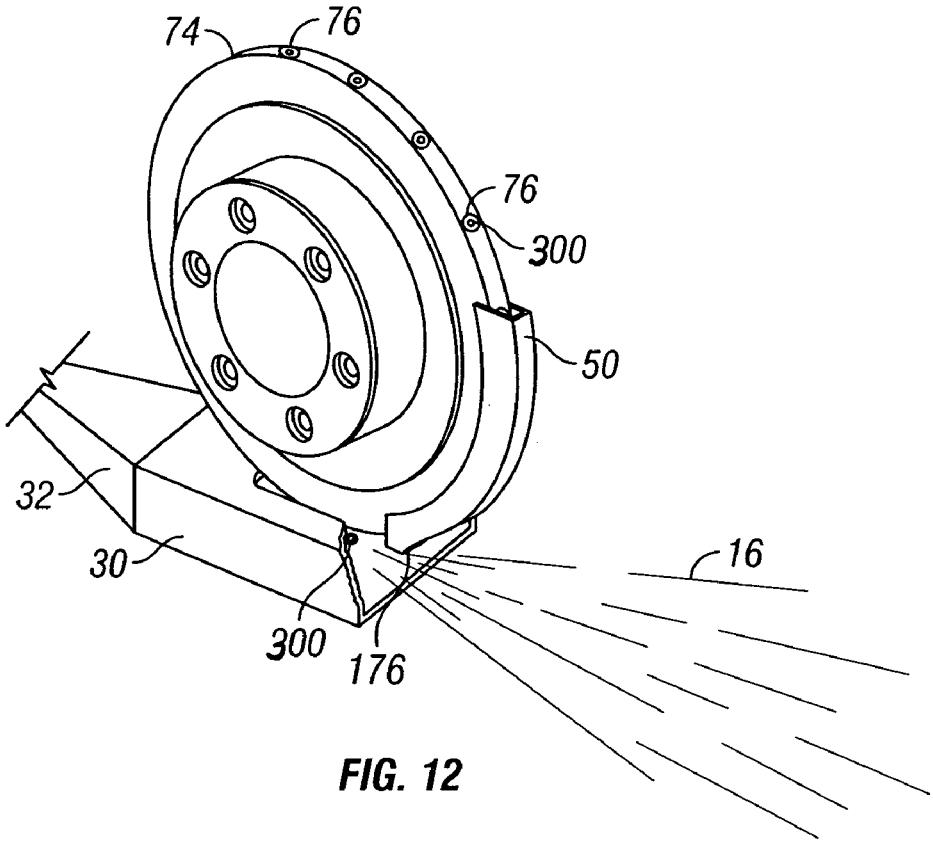
FIG. 12 is an enlarged perspective of a portion of the capsule insertion unit showing the capsule insertion wheel and two funnel.

The ledger housing 50 (FIGS. 1 and 12) is positioned as a rim over the peripheral face of the wheel 74 and is spaced from the wheel such that the wheel can rotate freely therein. Referring to FIG. 12, the ledger housing houses the wheel after the point of introduction of a capsule into the successive pockets along the periphery of the wheel 74 (as discussed in detail above). The ledger housing extends over the peripheral face of the wheel 74 to near that region where the capsule can be conveniently removed from the pocket 76 and positioned within the filter material (as discussed in detail above). Typically, the peripheral face of the wheel 74 is not covered by the ledger housing 50 in the region where the capsule is released from the pocket. Preferably, the ledger housing provides a plow or shoe 176 to part or separate the web of filter material to ensure that the capsule is well positioned within the material (as discussed in detail above). The ledger housing is manufactured from pre-tempered, cold-rolled steel, or the like.

The rate of supply of web of filter material, the rate of rotation of the wheel of the capsule insertion unit and the rate of supply of strand can be controlled such that the capsules which are formed are positioned at the desired, predetermined intervals within the web of filter material. In particular, the rate of feed of capsules through the transfer means 54, the positioning of the capsules within each pocket 76, the rate of rotation of the wheel 74, and subsequent positioning of the capsules within the resulting filter rod are synchronized with respect to the rate at which the filter material 16 is fed into the rod-forming unit 12. Other suitable configurations for providing a control of the feed of capsules, rotation of wheel and feed of filter material may be apparent to the skilled artisan.

The individual capsules 300 remain well positioned in each respective pocket until the insertion of the capsule into the web of filter material is desired. In particular, the rim-like nature of the ledger housing 50 and plow 176 relative to each pocket 76, and the relative close spacing of the inner surface of the ledger housing and plow relative to the outer face of the pocket, in combination with the supply of vacuum and air ejection allows each individual capsule to be maintained within the respective pocket, preferably without moving longitudinally within the pocket, until each capsule is deposited within the web of filter material.

Referring to FIG. 12, the continuous web of filter material 16 is fed into guide or block 30 (shown as partially cut away). The guide 30 receives the wide band of filter material, and gradually forms the web into a composite, which generally resembles a cylindrical composite. The plow 176 of the ledger housing separates or spreads the filter material such that the capsule 300 is positioned or placed at the desired location within the web of filter material. When the tow reaches the endmost portion of the plow, the motion of the tow acts to close itself into a cylindrical composite, which contains the individual capsules at the desired locations therein. A suitable plow preferably has a maximum depth of about 0.25 inch.

The capsule is maintained within a pocket until the location at which the ledger housing does not cover the wheel as a rim, at which point the capsule is inserted into the web of filter material with the assistance of air ejection through the bearing housing 138 as described above. In such a manner, the action of gravity is assisted and the capsule is forced from the selected pocket into the web of filter material at the desired location. The air is received from a source (not shown) such as a laboratory air supply, or other suitable means. Other techniques for assuring removal of each capsule from each pocket at the desired location (e.g., the use of mechanical or pneumatic plungers) may be apparent to the skilled artisan.

Figure 13:
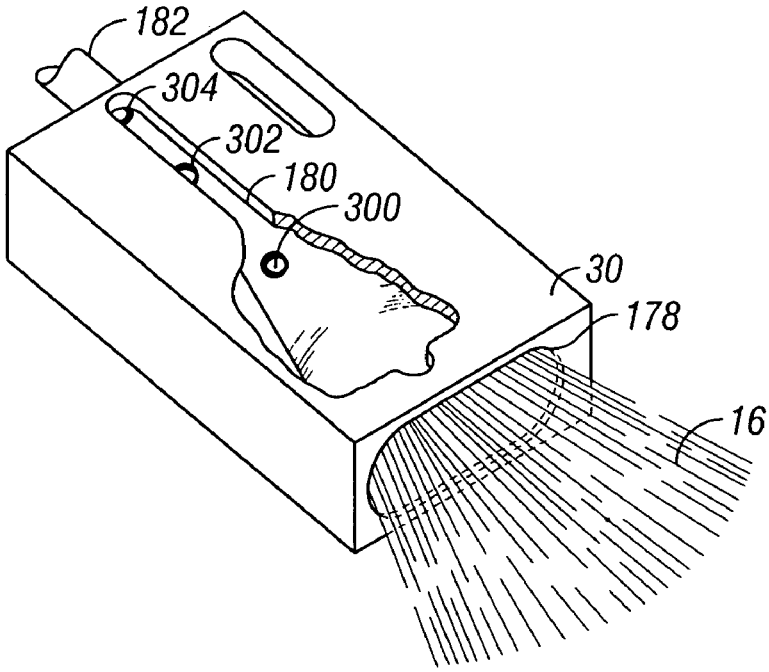
FIG. 13 is an enlarged perspective of a portion of the capsule insertion unit showing filter tow and the position of placement of a capsule within the filter material.

Referring to FIG. 13, the guide or block 30 (the top portion of which is shown as partially cut away) has a relatively wide opening 178 at one end in order that the filter material 16 can be fed therein. A suitable wide opening is about 0.5 inch high and about 2.5 inches in width. A suitable block has a length of about 5.5 inches. The shape of the hollow inner portion of the block is such that the filter material is formed into a composite, which more generally resembles a cylinder. A suitable composite is about 9/16 inch in diameter. In particular, the inner portion of the block 30 is a hollow region or cavity in order that the filter material can be passed therethrough. The block has a longitudinally extending slot 180 along the top portion thereof in order to allow the rotating wheel and ledger housing (not shown) to extend into the web of filter material and to insert a capsule 300 at the desired location therein. A suitable slot is about 4 inches long for a block having a length of about 5.5 inches. In a suitable situation, the plow extends into the slot so as to extend about 1/8 inch from the extreme bottom portion of the hollow inner portion of the block. The cylindrical composite 182 is received by the receiving means of the rod-forming unit (as discussed hereinafter). In such a manner, a series of capsules 300, 302 and 304 are positioned in the web at predetermined intervals within the cylindrical composite 182 which exits block 30 into a gathering means such as a tongue (not shown). Similar blocks are described in Green et al., U.S. Pat. No. 4,862,905, which is hereby incorporated herein by reference.

Figure 14:
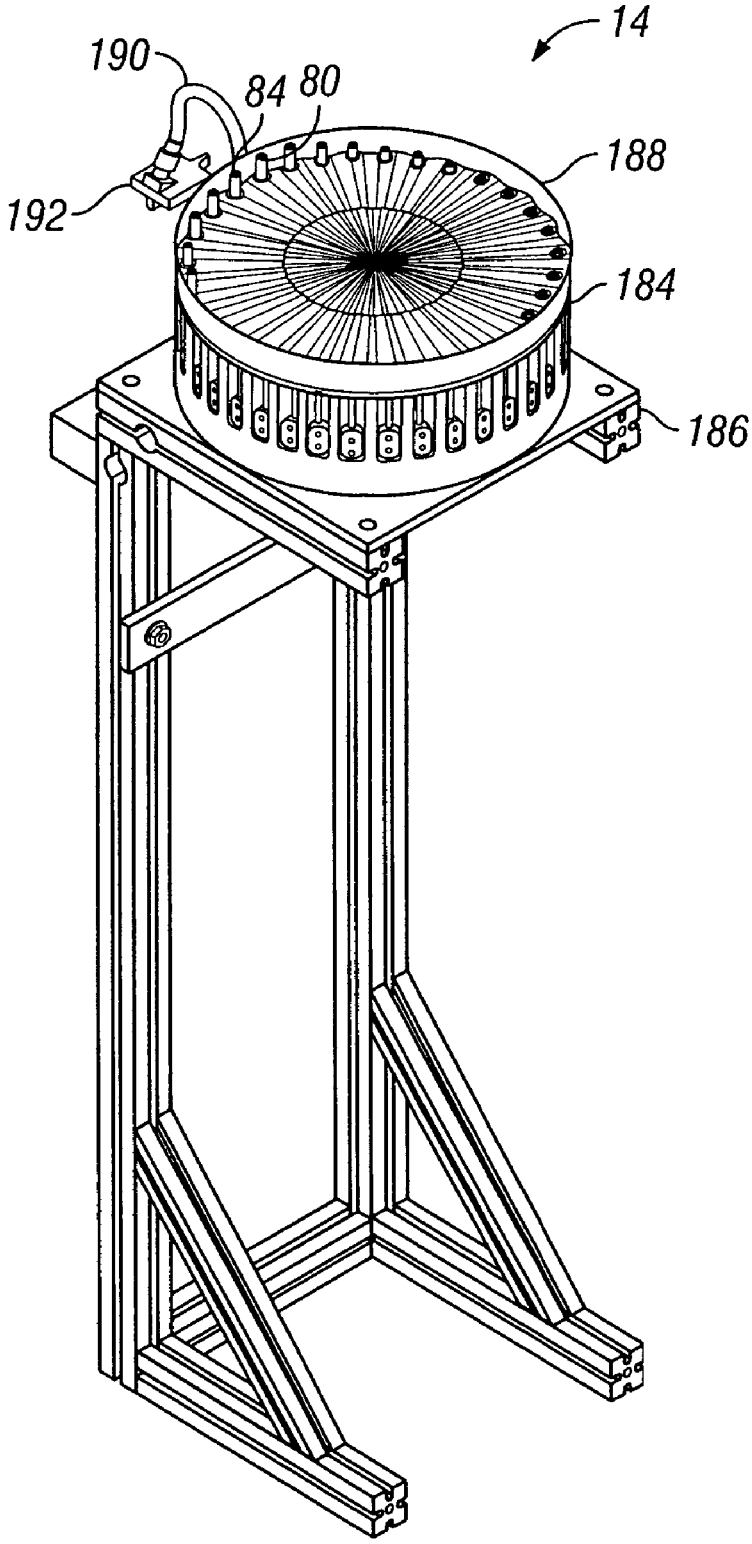
FIG. 14 is a perspective of a first alternate embodiment of a capsule insertion unit.

Referring now to FIG. 14, an alternative embodiment of the capsule insertion unit 14 is shown. In this embodiment, a carousel 184 is supported on a stand 186 to be positioned in front of the rod-making apparatus 10 (FIG. 1). The carousel 184 is similar to the carousel 60 described in FIG. 3. A series of stems 80 around the periphery of the carousel rise and fall as the carousel rotates. When the stem is at its maximum height or apex position 84 and located just below a transfer tube 190, a positive air supply ejects the capsule from the stem which has been previously held by a vacuum and forces the capsule to travel through a transfer tube 190 into an insertion plow 192. The insertion plow 192 is positioned over the gathering filter material 16 in position where the block 30 is located. (see FIG. 1) A skirt 188 around the top of the carousel retains the capsules on the surface plate of the carousel. The height of the skirt 188 is sufficient to retain a predetermined amount of capsules that are fed to the carousel.

Figure 15:
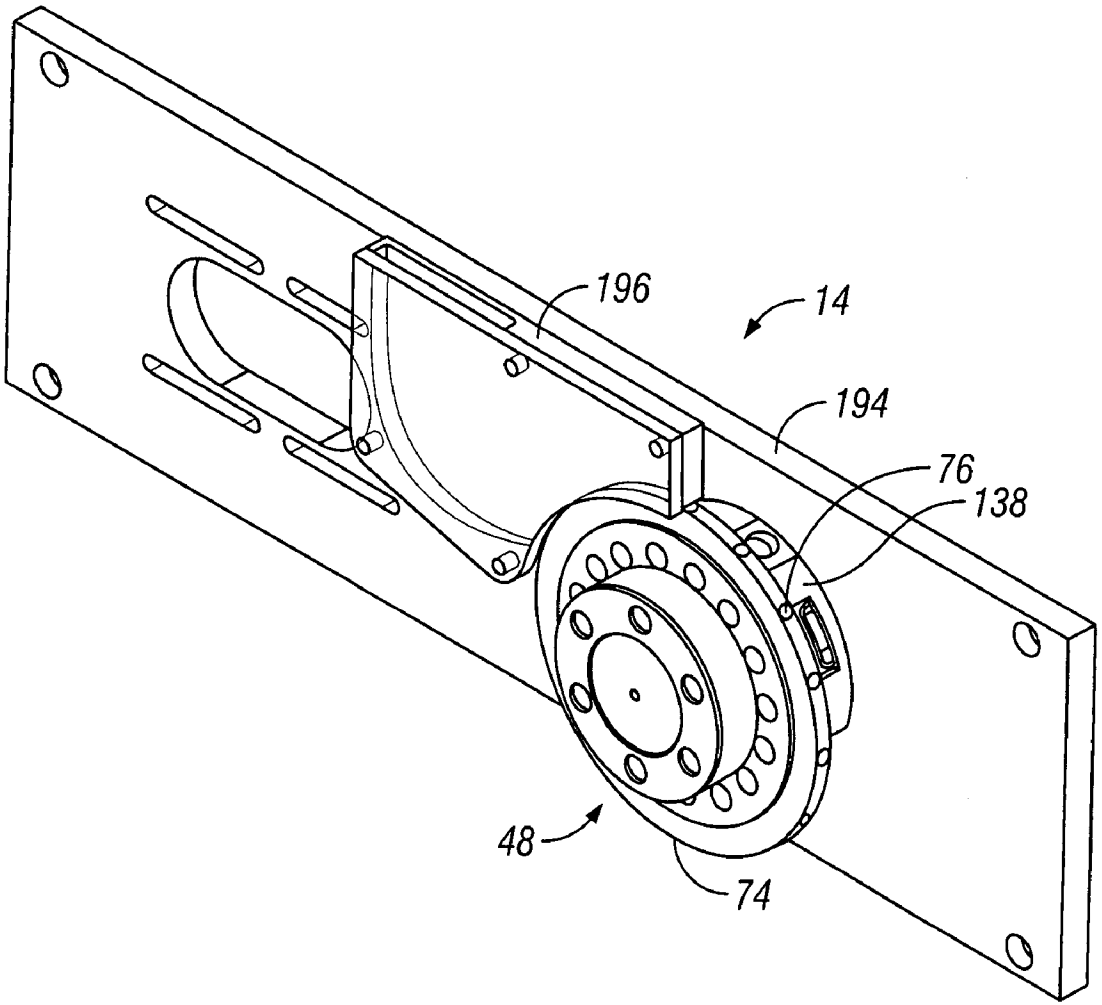
FIG. 15 is a perspective of a second alternate embodiment of a capsule insertion unit.

Referring to FIG. 15 yet another embodiment of the capsule insertion unit 14 is shown. In this embodiment a rotatable member 48 includes an insertion wheel 74 and bearing housing 138 as previously described. The bearing housing is attached to a support plate 194. Also attached to the support plate is a feed hopper 196. The feed hopper receives capsules and places them along a portion of the periphery of the insertion wheel 74. With the vacuum assistance applied to the insertion wheel pockets 76, the pockets grab capsules as the pockets rotate along side the feed hopper 196. As the insertion wheel 74 rotates, the capsules are brought down into the filter material and ejected into gathering stream of filter material in the block as previously described.

Figure 16:
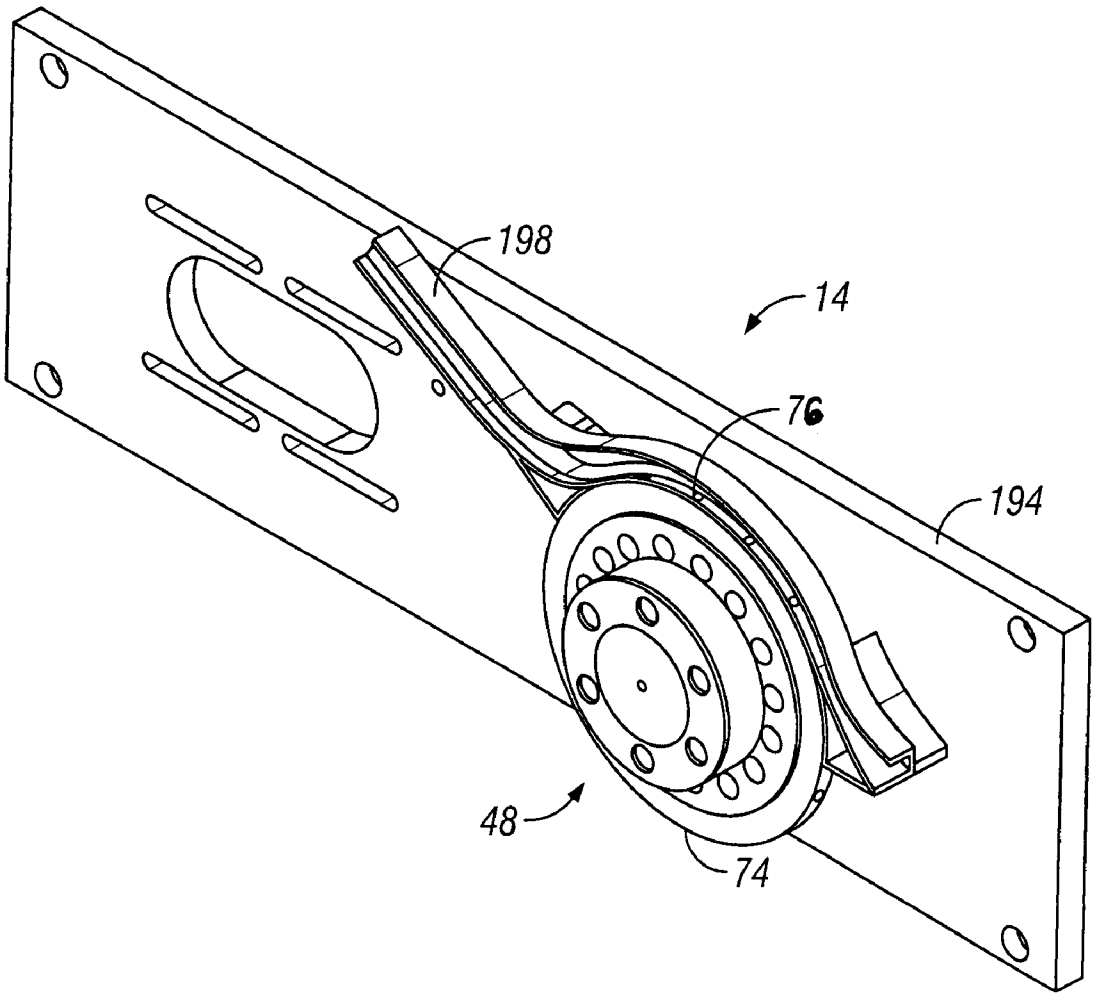
FIG. 16 is a perspective of a third alternate embodiment of a capsule insertion unit.

Referring to FIG. 16, still yet another alternative embodiment of capsule insertion unit 14 is shown. In this embodiment, a rotatable member 48 as previously described having an insertion wheel 74 is mounted on support plate 194. A capsule feed channel 198 is also mounted above the insertion wheel 74 on the support plate 194. The feed channel 198 is in communication with a supply of capsules. The capsules flow along the feed channel 198 and ride over in a direct contact with the insertion wheel. The capsules may flow in a continuous stream, recirculating to a feed hopper to maintain a supply of capsules on the feed channel. As the insertion wheel rotates, a vacuum applied to a pocket 76 sucks a capsule from the feed channel. As the insertion wheel 74 rotates, the vacuumed capsule is brought around and down into the filter material in the block 30 below the insertion wheel.

Figure 17:
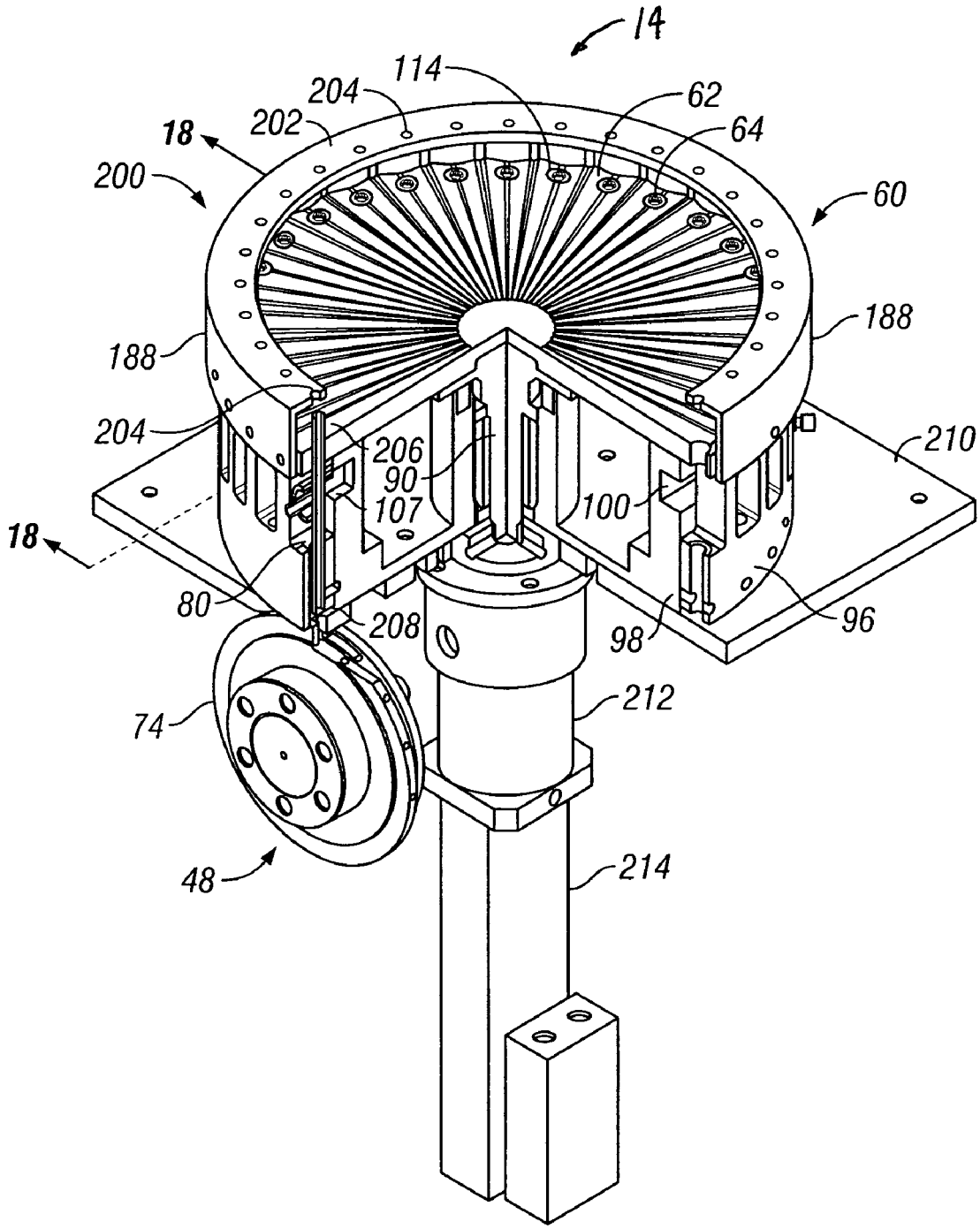
FIG. 17 is a perspective of a fourth alternate embodiment of a capsule insertion unit with a portion of the unit shown as partially cut away.

Referring to FIG. 17, even another alternative embodiment of capsule insertion unit 14 is shown in perspective with a portion partially cut away. In this embodiment, a horizontally disposed rotatable member 200 is mounted on a platform 210. Juxtaposed the horizontally disposed rotatable member 200, a vertically disposed rotatable member 48, as previously described, having an insertion wheel 74 is positioned to receive capsules individually transferred from the rotatable member 200. The drive shaft of the carousel 60 is shown connected to a drive motor 212 on a stand 212, although any suitable means as known to one of ordinary skill in the art may be modified for rotating the carousel. The cam drum 98 is fixed to the stand 210.

Figure 18:
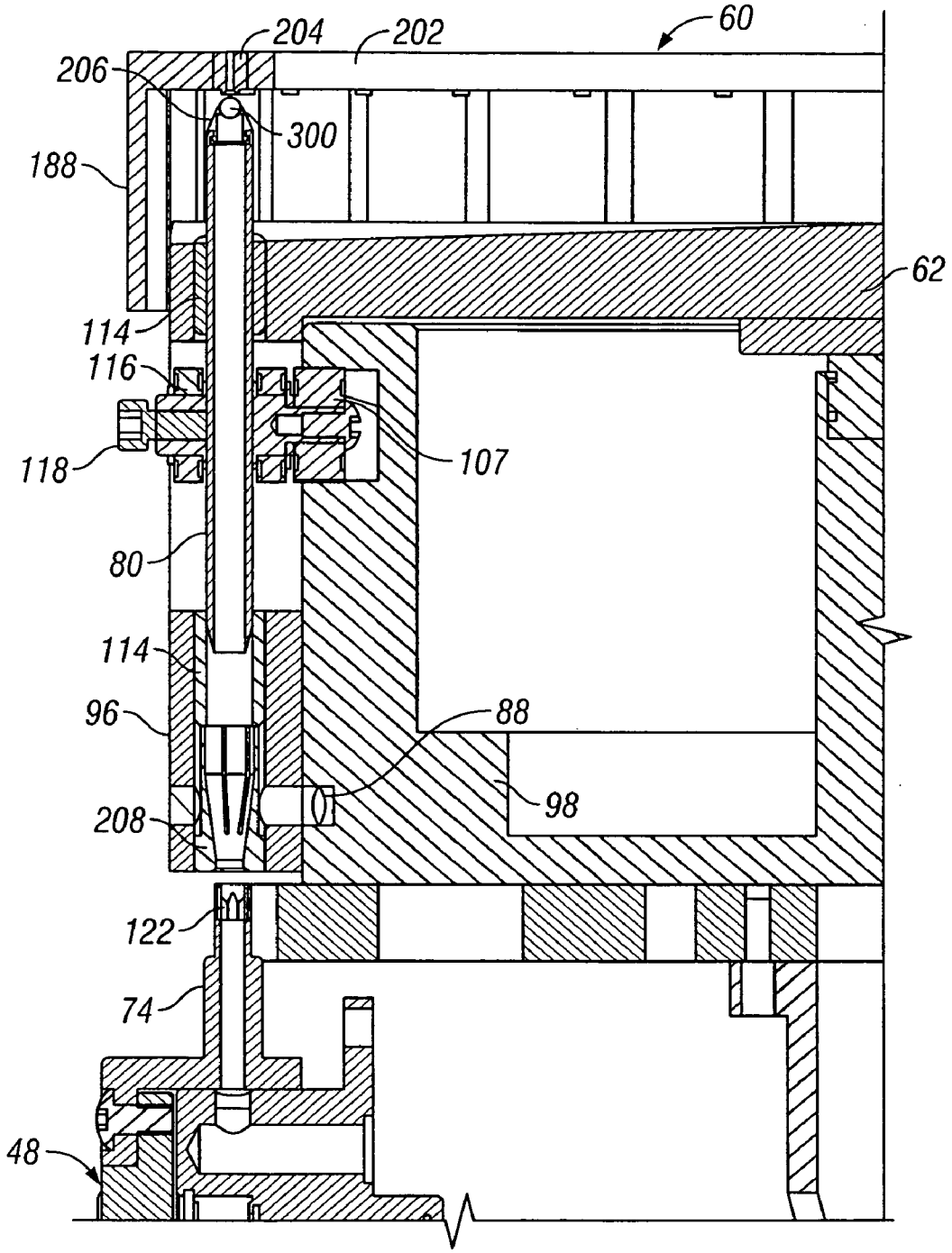
FIG. 18 is a cross-section view of the capsule insertion unit of FIG. 17 taken along lines 18—18.

Referring to both FIG. 17 and FIG. 18, which is a cross-sectional illustration of the capsule insertion unit 14 of FIG. 17 taken along lines 18—18, the rotatable member 200 includes a carousel 60 having a pan 62 with swales, stem holes 64, and bushings 114 and a carousel skirt 96, as previously described. The operation of the stem lifters 80 is modified in this embodiment so that, instead of lifting the capsule to a separate transfer tube as in a previous embodiment, the stem lifter has an enlarged hollow interior to also act as the transfer tube. The carousel 60 includes a retaining wall or skirt 188 fixed around the upper perimeter of the pan. At the top of the retaining wall 188, a flange 202 extends radially inward to cover the stem holes 62. A plurality of ejector pins 204 is mounted on and extending from the underside of the flange 202. Each ejector pin 204 is positioned over a hole 62. Each stem lifter 80 has a ball seat 206 at the top of the stem lifter and a ball catcher 208 at the bottom of the stem.

In operation, as the pan 62 rotates, the cam followers 107 rise and fall following the path of the cam channel 100. The stem lifters 80, which are attached to the cam followers also rise and fall. As the top of the stem lifter moves below the surface of the pan 62, a capsule from the pan will move onto the ball seat 206. Vacuum assistance via a vacuum channel 88 may be provided to ensure capture of a capsule onto the ball seat, as described above for a previous embodiment. When the stem lifter rises to near its apex, the capsule comes into contact with the ejector pin 204 above the capsule. The ejector pin may be made of any hard material, such as UHMW (Ultra-High-Molecular-Weight) polyethylene or aluminum. The ejector pin 204 forces the capsule through the ball seat, which is made from a soft resilient material, such as an elastomer that, when the object or capsule 300 is a sphere, preferably has between about 65–70 durometer. Such exemplary elastomers include, for example, EPDM (Ethylene Propylene Diene Monomer), silicone rubber or natural gum rubber. The capsule drops through the hollow interior of the stem lifter down to the ball catcher 208, which is made from a hard material, such as UHMW polyethylene or aluminum. When the carousel rotates, the capsule inside the ball catcher 208 rolls along the surface of the platform 210 until the ball catcher moves to a position adjacent a pocket in the insertion wheel 74. Then the capsule is drawn into the capsule seat 122 in the pocket, which may occur by gravity or with assistance from a combination of one or more of a release of a vacuum from the cam drum, an air ejection from the cam drum or a vacuum applied through the insertion wheel, as described above for previous embodiments.

Figure 19:
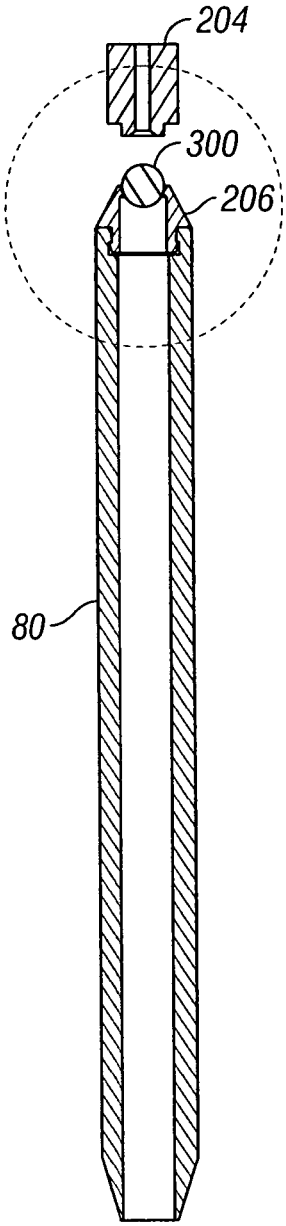
FIG. 19 is an enlarged cross-sectional view of the stem lifter of FIG. 18.
Figure 20:
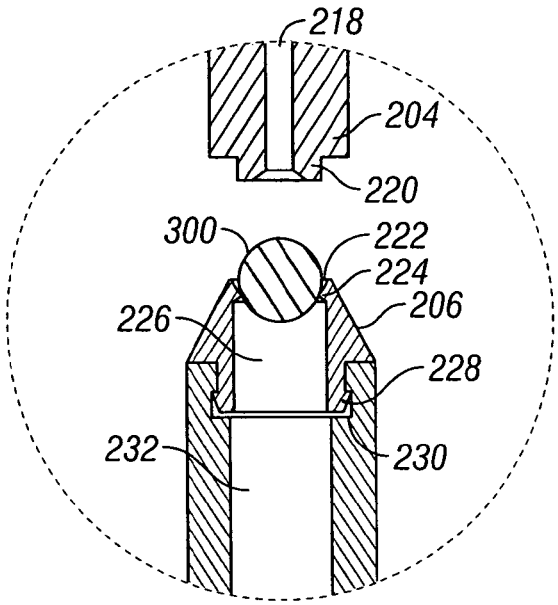
FIG. 20 is an enlarged cross-sectional view of the top of the stem lifter and push rod of FIG. 19.

FIGS. 19 and 20 depict in greater detail the cooperation between the stem lifter 80 and the ejector pins 204. An ejector pin 204 is positioned above a capsule 300 on a ball seat 206 at the top of the stem lifter 80. The ejector pin 204 includes a hollow passageway 218 to optionally allow for the use of air through the ejector pin to assist with forcing the capsule through the ball seat 206. The tip 220 of the ejector pin preferably includes a spherical surface with a curvature to match the surface of the capsule 300 to evenly distribute the forces against the capsule when the capsule is forced up against the tip 220 of the ejector pin. The ball seat 206 includes a capsule seat surface 222 established to seat a capsule at a sufficient depth to secure the capsule within the seat against the rotational centrifugal forces being applied to the capsule. Optionally, vacuum assistance through the stem lifter 80 may be used to help secure the capsule to the ball seat. A narrowed neck section 224 is below the seat surface 222. The neck 224 has an opening with a slightly smaller internal diameter than the outside diameter of the capsule. For example, for a capsule having a crush strength about 1000 grams and an outside diameter of 3.5 mm, the neck opening 224 may be 3.2 mm. The relative dimensions may be selected to obtain the desired resistance to the passage of the capsule depending on the crush strength of the capsule. When the ejector pin urges the capsule through the neck, the downward force on the capsule stretches the resilient neck to open wide enough to accept the capsule. The capsule 300 then drops through the throat 226 and through the stem lifter interior where the capsule is transferred down to the ball catcher to await transfer to the insertion wheel. The ball seat 206 may be retained on the stem lifter by a lip 228 engaging a groove 230 in the top of the stem lifter, or by other means known in the art.

Figure 21:
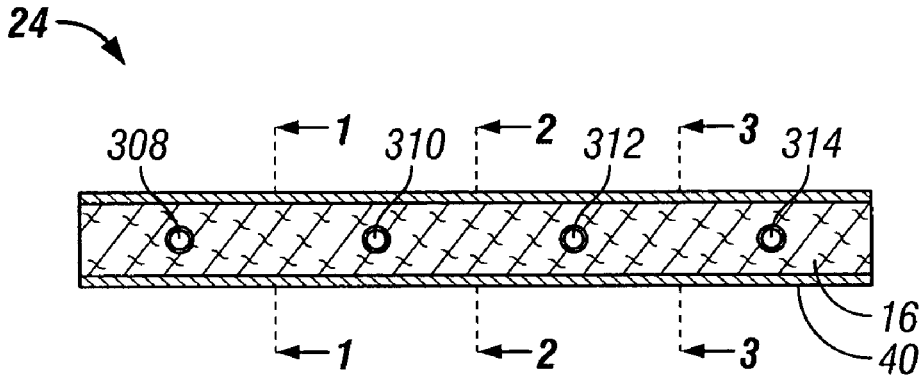
FIG. 21 is a longitudinal cross-sectional illustration of a filter rod including filter material and capsules positioned at predetermined and controlled intervals therein.

Referring to FIG. 21, filter rod 24 generally can be further subdivided into cylindrical shaped filter elements using techniques as are known by the skilled artisan familiar with conventional cigarette manufacturing. The filter rod 24 includes filter material 16 encased in circumscribing wrapping material 40 such as conventional air permeable or air impermeable paper plug wrap, or other suitable wrapping material. As an example, four capsules 308, 310, 312 and 314 are individually spaced at predetermined intervals within the rod 24. In particular, each of the capsules is positioned along the rod in a spaced apart relationship from one another. As shown by lines 1—1, 2—2 and 3—3, respectively, the rod can be used as a "four up" rod to provide four filter elements. Other configurations such as the so called "six up" rods also can be manufactured. Rod sizes for use in the manufacture of filter elements for cigarettes can vary, but typically range in length from about 80 mm to about 140 mm, and from about 16 mm to about 27 mm in circumference. For example, a typical rod having a 100 mm length and a 24.53 mm circumference exhibits a pressure drop of from about 200 mm to about 400 mm of water as determined at an airflow rate of 17.5 cc/sec. using an encapsulated pressure drop tester, sold commercially as Model No. FTS-300 by Filtrona Corporation.

Figure 22:
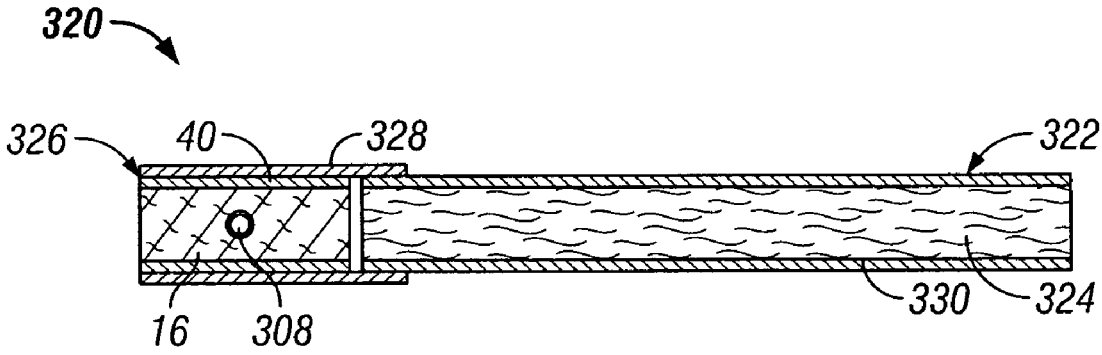
FIG. 22 is a longitudinal cross-sectional illustration of a cigarette having a rod of smokable material, and an axially aligned filter element having a capsule positioned therein.

Referring to FIG. 22, smoking article 320 has the form of a cigarette. The article 320 includes rod 322 including smokable material such as tobacco cut filler 324, or the like, contained in circumscribing wrapping material 330 such a conventional cigarette paper wrap. The ends of the rod are open to expose the smokable material. Generally, the length of the rod 322 ranges from about 55 mm to about 85 mm. The smoking article further includes filter element 326 positioned adjacent one end of rod 322 such that the filter element is aligned with the rod in an end-to-end relationship. Filter element 326 has a cross sectional shape similar to that of rod 322. The filter element 326 is provided from filter rod, the previously described filter rod and includes filter material 16, circumscribing plug wrap 40 and an individual capsule 308. The capsule 308 is positioned within the filter element such that the capsule cannot be observed by visual inspection of the extreme mouthend of the cigarette. For example, the capsule is centrally located longitudinally within the filter rod. The filter element 326 is attached to the rod 322 by tipping material 328, which circumscribes both the filter element and an adjacent region of the rod. The inner surface of the tipping material 328 is fixedly secured (e.g., using an adhesive) to the outer surface of the filter element 326 and to the wrapping material 330 of an adjacent region of the rod 322. The tipping material 328 circumscribes the rod 322 over a longitudinal length, which can vary but is typically that length sufficient to provide good attachment of the filter element to the rod. The tipping material can be a conventional air permeable or air impermeable tipping paper. The cigarette can be equipped with air dilution perforations or other means for providing air dilution thereto, if desired. It is understood that more than one individually placed capsule can be positioned within the filter element, if desired.

The size and shape of the capsule can vary. Generally, the capsule has a generally spherical shape. Preferably, the capsule is of a size such that each individual capsule can be positioned within the filter element of a cigarette without providing negative properties to the smoking article. For example, it is desirable that the capsule not (i) stick out of the mouthend of the filter element or be otherwise visible; (ii) be so large that the draw resistance of the smoking article be undesirably affected; or (iii) provide an undesirable weight or feel to the smoking article. A suitable capsule for use in a filter element having a length of about 27 mm and a circumference of about 24.5 mm has a substantially spherical shape with a diameter of about 3.5 mm.

Most preferable inserted objects act as substrates for carrying or containing smoke modifying agents such as flavorants, salivators, or the like. The amount of smoke modifying agent carried or contained by an individual capsule depends upon the properties and characteristics of the smoke modifying agent, the characteristics of the agent, the desired delivery of smoke modifying agent, and other such factors.

A representative capsule 300 is generally spherical in shape. Such a capsule possesses an outer shell that surrounds an internal payload. The outer shell most preferably encloses the payload in such a manner that the payload is tightly sealed. The shape of the capsule can vary, but the capsule most preferably is spherical. Most preferably, the capsules have high degrees of roundness, and possess consistent physical specifications (e.g., consistent dimensions, consistent weights and consistent formulations) in order to enhance the ability to manufacture cigarettes incorporating those capsules using automated machinery, and in order to produce cigarettes of consistent quality. Suitable capsules are commercially available from Mane Aromatic Flavors, located in Nice, France as gelatin encapsulated mixtures of medium chain triglycerides and flavor agents. The designations of a number of flavor capsules that are available from Mane Aromatic Flavors are: Spearmint, E209123; Cinnamon, E0303392; Russian Tea, E0303386; Lemon, E127382; and Menthol, E127384. Such representative capsules have diameters of about 3.5 mm and about 4 mm.

The capsule outer shell or surface is preferably constructed of somewhat rigid solid material that has a tendency not to leak, melt, crack, or otherwise lose its integrity between the time that it is manufactured and the time it is selectively ruptured by a smoker. Preferably, the capsule outer surface or wall is a continuous sealed one-piece member in order to reduce the likelihood of leakage of the capsule payload. The preferred capsule outer surface is brittle enough to readily rupture when squeezed by a smoker, but not so brittle that it breaks prematurely during manufacturing, packaging, shipping and use of the cigarette containing such a capsule. That is, the pressure required to rupture the capsule within the filter element is preferably low enough to be easily performed using the fingers of the smoker, but not so low as to result in accidental rupture of the cigarette during manufacturing, packaging, shipping, and smoking. Furthermore, the capsule outer surface preferably is constructed of material that does not adversely react with or otherwise undesirably affect the components of the payload, the cigarette tobacco, components of the filter element, or the mainstream smoke produced by the cigarette.

The capsule payload can have a form that can vary; and typically, the payload has the form of a liquid, a gel, or a solid (e.g., a crystalline material or a dry powder). The payload can incorporate components that aid in flavoring or scenting mainstream cigarette smoke. Alternatively, the payload may be a breath freshening agent for the smoker, a deodorizing agent for the cigarette butt, a moistening or cooling agent for the cigarette smoke, or a composition capable of otherwise altering the nature or character of the cigarette.

The payload most preferably has a liquid form. Such a payload can incorporate an aromatic material intended to be drawn to the smoker independent of the presence of mainstream smoke, or material can become entrained within mainstream smoke during draw by the smoker. Preferred liquid payloads have the ability to seep or wick throughout the filter material of the filter element (and in certain circumstances, into the tobacco rod), and hence be available to mix with the smoke drawn to the smoker.

In the preferred embodiment, the capsule 300 possesses an outer surface composed of gelatin and an internal payload incorporating an agent capable of altering the nature or character of mainstream smoke passing through the filter element. Typically, the outer shell consists primarily of gelatin, frequently is comprised at least about 80 weight percent gelatin, and preferably consists essentially of gelatin. Outer shells consisting of essentially pure gelatin are particularly preferred. The gelatin material is preferably of a food grade, and derived from bovine, picine or porcine stock. A wide variety of gelatins may be used, and the selection of a gelatin for the capsule outer surface is considered a matter of design choice to those of ordinary skill in the art. See, Kirk-Othmer, *Encyclopedia of Chemical Technology*, ($4^{th}$ Ed.) 12, 406–416 (1994), which is incorporated herein by reference. The type of gelatin used for constructing the outer shell of the capsule provides that capsule with the capability of being exposed to triacetin (a common plasticizer used in cigarette filter manufacture) or 1,2 propylene glycol (a common tobacco casing component) for relatively long periods of time without experiencing undesirable interaction (e.g., dissolution of the gelatin therein). Because the gelatins used in the preferred embodiments may dissolve in water over extended periods of time, it is desirable to employ virtually anhydrous payloads (or payloads possessing very low amounts of water) with capsules having gelatin outer coatings. The capsules can be colored brown, or some other dark color, for assisting in detection purposes during automated manufacturing processes.

In the preferred embodiment, the payload is a mixture of a flavoring and a diluting agent or carrier. The preferred diluting agent is a triglyceride, such as a medium chain triglyceride, and more particularly a food grade mixture of medium chain triglycerides. See, for example, Radzuan et al., *Porim Bulletin,* 39, 33–38 (1999). Flavorings of the payload may be natural or synthetic, and the character of these flavors can be described, without limitation, as fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, and strawberry. See also, Leffingwill et al., *Tobacco Flavoring for Smoking Products*, R.J. Reynolds Tobacco Company (1972). Flavorings also can include components that are considered moistening, cooling or smoothening agents, such as eucalyptus. These flavors may be provided neat (i.e., alone) or in a composite (e.g., spearmint and menthol, or orange and cinnamon). Composite flavors may be combined in a single capsule as a mixture, or as components of multiple capsules positioned within the filter element.

The amount of flavoring and diluting agent within the capsule may vary. The relative amounts of flavoring and diluting agent selected, as well as the overall amount of the mixture of the two may be varied, for example, to provide different sensory experiences for the smoker. In some instances, the diluting agent may be eliminated altogether, and the entire payload can be composed of flavoring agent. Alternatively, the payload can be almost entirely comprised of diluting agent, and only contain a very small amount of relatively potent flavoring agent. In the preferred embodiment using a capsule of approximately 3.5 mm in diameter, the weight of the liquid payload (e.g., flavoring agent and diluting agent) is preferably in the range of about 15 mg to about 25 mg, and more preferably in the range of about 20 mg to about 22 mg. The preferred composition of the mixture of flavoring and diluting agent is in the range of about 5 percent to about 25 percent flavoring, and more preferably in the range of about 10 to about 15 percent flavoring, by weight based on the total weight of the payload, with the balance being diluting agent.

The weight of the capsule wall compared to the weight of the payload may vary. Preferably, the capsule wall is in the range of about 5 percent to about 50 percent, and more preferably in the range of about 10 to about 30 percent, of the total weight of the capsule. For a representative preferred capsule of approximately 3.5 mm in diameter, the capsule wall weighs about 2 mg to about 4 mg, and the payload weighs about 16 to about 21 mg. The payload volume typically can be about 50 percent to about 90 percent of the total volume of the capsule (i.e., including the wall and the payload), preferably about 70 percent to about 90 percent of the total capsule volume, and more preferably about 80 percent to about 90 percent of the total capsule volume.

The force required to rupture the preferred capsules before they are inserted into the filter element may be determined using a suitable force determining device, such as the Shimpo Model No. FGV10X manufactured by Shimpo Instruments, a division of the Nidec Group. When measured using a suitable device, such as the Shimpo device, the capsules preferably have individual crush strengths in the range of approximately 750 to 5000, more preferably less than approximately 2000, and still more preferably less than approximately 1500, most preferably approximately 1000 (units provided by the Shimpo device are reported in grams).

Other capsules and capsule components that can be employed in carrying out certain aspects of the present invention are of the type set forth in U.S. Pat. No. 3,685,521 to Dock; U.S. Pat. No. 3,916,914 to Brooks et al.; and U.S. Pat. No. 4,889,144 to Tateno et al.; U.S. Pat. Appl. No. 2003/0098033 to MacAdam et al.; and PCT WO 03/009711 to Kim; which are incorporated herein by reference.

Tobacco materials useful for carrying out the presence invention can vary. Tobacco materials can be derived from various types of tobacco, such as flue-cured tobacco, burley tobacco, Oriental tobacco or Maryland tobacco, dark tobacco, dark-fired tobacco and Rustica tobaccos, as well as other rare or specialty tobaccos, or blends thereof. Descriptions of various types of tobaccos, growing practices, harvesting practices and curing practices are set for in *Tobacco Production, Chemistry and Technology*, Davis et al. (Eds.) (1999). Most preferably, the tobaccos are those that have been appropriately cured and aged.

Typically, tobacco materials for cigarette manufacture are used in a so-called "blended" form. For example, certain poplar tobacco blends, commonly referred to as "American blends," comprise mixtures of flue-cured tobacco, burley tobacco and Oriental tobacco. Such blends, in many cases, contain tobacco materials that have a processed form, such as processed tobacco stems (e.g., cut-rolled or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). The precise amount of each type of tobacco within a tobacco blend used for the manufacture of a particular cigarette brand varies from brand to brand. See, for example, *Tobacco Encyclopedia*, Voges (Ed.) p. 44–45 (1984), Browne, *The Design of Cigarettes,* 3rd Ed., p. 43 (1990) and *Tobacco Production, Chemistry and Technology*, Davis et al. (Eds.) p. 346 (1999). Other representative tobacco types and types of tobacco blends also are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; and U.S. Pat. No. 5,360,023 to Blakley et al.; U.S. Pat. Application 2002/0000235 to Shafer et al.; PCT WO 02/37990; U.S. patent application Ser. No. 10/285,395, filed Oct. 31, 2002; and Bombick et al., *Fund. Appl. Toxicol.,* 39, p. 11–17 (1997).

Tobacco materials typically are used in forms, and in manners, that are traditional for the manufacture of smoking articles, such as cigarettes. The tobacco normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco filler normally used within the tobacco rod of a cigarette ranges from about 0.6 g to about 1 g. The tobacco filler normally is employed so as to fill the tobacco rod at a packing density of about 100 mg/cm$^3$ to about 300 mg/cm$^3$, and often about 150 mg/cm$^3$ to about 275 mg/cm$^3$.

If desired, the tobacco materials of the tobacco rod can further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

Smoke modifying agents which are carried or contained by the capsules include flavorants such as menthol, cinnamon, citrus, cocoa, licorice, tobacco extract, nicotine, and the like. For example, a typical filter element can contain one capsule containing from about 1 to about 10 percent of menthol, based on the total weight of the capsule. The use of flavor-containing capsules in filter elements of smoking articles provides for a well controlled application of desirable ingredients such as flavors into the smoking article. Of particular interest is the fact that certain materials can provide a continuous, controlled release of certain ingredients over time. In addition, the level of flavorant delivered to the user can be well controlled, as when the flavorant is entrained in the mainstream aerosol during draw. As the flavorants are delivered to an appreciable degree from the filter element of the smoking article, a relatively large amount of flavorant is not subjected to the high temperatures experienced in other regions of the smoking article (e.g., in the tobacco rod). In addition, the filter element is capable of modifying (e.g., flavoring) the aerosol delivered by a smoking article without the necessity of noticeably affecting the appearance or structure of the smoking article.

The outer wrapping material of the tobacco rod can vary. Preferably, the outer wrapping material is a paper material, such as the type of paper material typically used in cigarette manufacture. The wrapping material can have a wide range of compositions and properties. The selection of a particular wrapping material will be readily apparent to those skilled in the art of cigarette design and manufacture. Smokable rods can have one layer of wrapping material; or smokable rods can have more than one layer of circumscribing wrapping material, such as is the case for the so-called "double wrap" smokable rods. Exemplary types of wrapping materials, wrapping material components and treated wrapping materials are described in U.S. Pat. No. 5,105,838 to White et al.; U.S. Pat. No. 5,271,419 to Arzonico et al. and U.S. Pat. No. 5,220,930 to Gentry; PCT WO 01/08514 to Fournier et al.; PCT WO 03/043450 to Hajaligol et al.; U.S. Pat. Application 2003/0114298 to Woodhead et al.; U.S. Pat. Application 2003/0131860 to Ashcraft et al.; and U.S. patent application Ser. No. 10/324,418, filed Dec. 20, 2002 and Ser. No. 10/440,290, filed May 16, 2003; which are incorporated herein by reference in their entireties. Representative outer wrapping materials are commercially available as R.J. Reynolds Tobacco Company Grades 119, 170, 419, 453, 454, 456, 465, 466, 490, 525, 535, 557, 652, 664, 672, 676 and 680 from Schweitzer-Maudit International. The porosity of the outer wrapping material can vary, and frequently is between about 5 CORESTA units and about 100 CORESTA units, often is between about 10 CORESTA units and about 90 CORESTA units, and frequently is between about 20 CORESTA units and about 80 CORESTA units.

Preferred cigarettes made by the present invention exhibit desirable resistance to draw, whether or not the capsules within their filter elements are broken. For example, an exemplary cigarette exhibits a pressure drop of between about 50 and about 200 mm water pressure drop at 17.5 cc/sec. air flow. Preferred cigarettes exhibit pressure drop values of between about 70 mm and about 180 mm, more preferably between about 80 mm to about 150 mm, water pressure drop at 17.5 cc/sec. air flow. Typically, pressure drop values of cigarettes are measured using a Filtrona Filter Test Station (CTS Series) available form Filtrona Instruments and Automation Ltd.

One of ordinary skill in the art will understand that the teachings herein may be used to make in accordance with this invention alternative configurations of filters incorporating capsules or other objects. For example, U.S. patent application Ser. No. 10/600,712, filed Jun. 23, 2002, by Dube et al., entitled "Filtered Cigarette Incorporating A Breakable Capsule" and commonly owned by the assignee of the present application, describes hollow filters and segmented filters which incorporate breakable flavorant capsules. This application is hereby incorporated herein by reference.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for providing rods for use in the manufacture of smoking articles, each rod having objects individually spaced at predetermined intervals along the length thereof, the apparatus comprising:

(a) means for providing a continuous supply of rod filler material;

(b) means for continuously supplying individual objects, such means including a first rotatable member having a horizontal pan for supporting a plurality of individual objects and a plurality of stems located at predetermined intervals around the periphery of the pan, said horizontal pan being substantially perpendicular to an axis of rotation of the first rotatable member, the stems having an object seat at an upper end of the stem and coupled with an actuator to rise and lower the seat from a position below the pan to a position above the pan as the horizontal pan rotates about a central axis, said horizontal pan including means for delivering said object from a radially inward portion of the pan to a radially outward peripheral portion of the pan proximate the object seat at the upper end of the stem;

(c) means for positioning the individual objects within the supply of filler material at predetermined intervals;

(d) means for forming a continuous rod having the individual objects positioned at predetermined intervals in the rod; and (e) means for subdividing the continuous rod at predetermined intervals.

2. The apparatus of claim 1 wherein the means for providing a continuous supply of rod filler material is a means for supplying a continuous web of filter material, and wherein the means for positioning the individual objects at predetermined intervals within the web of filter material includes a second rotatable member having a plurality of pockets positioned at predetermined intervals along a peripheral face of the second rotatable member and within the pockets means for receiving the individual objects to place the object into the web of filter material.

3. The apparatus of claim 2 further including means for assuring ejection of each individual object within the web of filter material.

4. The apparatus of claim 3 wherein the means for assuring ejection include a supply of positive pressure air connected to a passage in communication with a pocket when the pocket is at a predetermined position proximate the web of filter material.

5. The apparatus of claim 2 wherein the means for receiving the individual objects is a hollow tube-shaped section positioned within the pockets and having a cylindrical-shaped side wall and a plurality of protrusions at least partly extending inwardly from the side wall, the protrusions being shaped to support the individual object.

6. The apparatus of claim 5 wherein the plurality of protrusions define a gap between the plurality of protrusions, the gap being sufficiently large to extend beyond the diameter of an object supported on the protrusions.

7. The apparatus of claim 2 further comprising means for controlling the rate of rotation of the first rotatable member and the second rotatable member such that movement of a stem is synchronized with the movement of the pocket to permit transfer of an object from a stem to a pocket.

8. The apparatus of claim 1 wherein the means for supplying the individual objects further comprises a transfer tube having an inlet for the object above the pan and an outlet for the object below the pan.

9. The apparatus of claim 8 wherein the means for positioning the individual object includes a plow positioned proximate the filler material and having a port in communication with the outlet of the transfer tube.

10. The apparatus of claim 1 wherein the means for subdividing the continuous rod includes an object detection means for transmitting a signal representative of a location of an object within the rod to adjust the location where the rod is subdivided relative the object.

11. The apparatus of claim 1, wherein the means for delivering comprise swales between a center portion of the pan and the peripheral portion of the pan proximate the object seat at the upper end of the stem.

12. The apparatus of claim 2, wherein the means for supplying the individual objects further comprise transfer tubes having an inlet for the object above the pan and an outlet for the object below the pan, wherein the transfer tubes are positioned around the periphery of the first rotatable member such that the outlet of a transfer tube moves proximate to a pocket in the second rotatable member as the first rotatable member rotates the transfer tube into a position proximate the second rotatable member.

13. The apparatus of claim 2, wherein the axis of rotation of the first rotatable member is perpendicular to an axis of rotation of the second rotatable member.

* * * * *